US009157449B2

(12) United States Patent
Sato et al.

(10) Patent No.: US 9,157,449 B2
(45) Date of Patent: Oct. 13, 2015

(54) MULTI-BLADE CENTRIFUGAL FAN AND AIR CONDITIONER USING THE SAME

(75) Inventors: Seiji Sato, Tokyo (JP); Tsuyoshi Eguchi, Tokyo (JP); Atsushi Suzuki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 664 days.

(21) Appl. No.: 13/578,891

(22) PCT Filed: Jun. 6, 2011

(86) PCT No.: PCT/JP2011/062958

§ 371 (c)(1),
(2), (4) Date: Aug. 14, 2012

(87) PCT Pub. No.: WO2012/008238

PCT Pub. Date: Jan. 19, 2012

(65) Prior Publication Data

US 2012/0315135 A1 Dec. 13, 2012

(30) Foreign Application Priority Data

Jul. 16, 2010 (JP) ..... 2010-161748
Mar. 16, 2011 (JP) ..... 2011-057792

(51) Int. Cl.
*F04D 29/38* (2006.01)
*F04D 29/28* (2006.01)
*F04D 29/30* (2006.01)

(52) U.S. Cl.
CPC ..... *F04D 29/281* (2013.01); *F04D 29/30* (2013.01)

(58) Field of Classification Search
CPC ..... F04D 29/281; F04D 29/30; F04D 29/384; F04D 29/386
USPC ..... 415/204
See application file for complete search history.

(56) References Cited

U.S. PATENT DOCUMENTS

2003/0053911 A1* 3/2003 Sakai et al. ..... 415/206

FOREIGN PATENT DOCUMENTS

| | | | |
|---|---|---|---|
| JP | 7-4389 | A | 1/1995 |
| JP | 7-247999 | A | 9/1995 |
| JP | 2000-145693 | A | 5/2000 |
| JP | 2000-240590 | A | 9/2000 |
| JP | 3387987 | B2 | 3/2003 |
| JP | 2006-200525 | A | 8/2006 |
| JP | 2006-336558 | A | 12/2006 |

OTHER PUBLICATIONS

International Search Report of PCT/JP2011/062958, mailing date of Aug. 16, 2011.

* cited by examiner

*Primary Examiner* — Edward Look
*Assistant Examiner* — Aaron R Eastman
(74) *Attorney, Agent, or Firm* — Westerman, Hattori, Daniels & Adrian, LLP

(57) ABSTRACT

In a multi-blade centrifugal fan including an impeller (7) rotatably disposed in a casing and composed of a disc-shaped hub (8), a plurality of blades (9), and an annular shroud (10), the blades (9) are curved in a concave shape on a pressure side in a cross-section perpendicular to a rotating shaft of the impeller (7) and have a curved shape that is backward-swept near a leading edge (9C) thereof and that is forward-swept near a trailing edge (9D) thereof, the inner diameter of the cascade of blades (9) increases gradually from the hub (8) toward the shroud (10), and the diameter of a maximum-curvature position (9B) where the curvature of the curved shape is maximized increases gradually from the hub (8) toward the shroud (10).

18 Claims, 16 Drawing Sheets

MULTI-BLADE CENTRIFUGAL FAN AND AIR CONDITIONER USING THE SAME

TECHNICAL FIELD

The present invention relates to multi-blade centrifugal fans suitable for use with air conditioners or air blowers in, for example, buildings and automobiles and to air conditioners using these multi-blade centrifugal fans.

BACKGROUND ART

Multi-blade centrifugal fans, called sirocco fans, include an impeller composed of a disc-shaped hub whose center is convex on the intake side, a plurality of blades (also called blades, vanes, or the like) arranged radially on the periphery of the hub, and an annular shroud disposed at the opposite ends of the blades from the hub, and a scroll-shaped fan casing in which the impeller is rotatably supported. For a typical multi-blade centrifugal fan, the shape of the blades in a cross-section perpendicular to the rotating shaft of the impeller is substantially uniform in the axial direction, that is, two-dimensional. This is so that the impeller can be formed by plastic molding at relatively low cost.

The multi-blade centrifugal fan deflects a flow taken in in the direction along the rotating shaft to a centrifugal direction perpendicular to the rotating shaft through the impeller and blows it from the periphery of the impeller into the casing. This causes a problem in that it is difficult to fully utilize the entirety of the blades because the flow is insufficiently deflected on the shroud side, which is closer to an intake port, and also less easily reaches the vicinity of the hub, with the result that the flow concentrates at a position slightly closer to the hub than the center of the blades in the spanwise direction. In addition, because the blades have a uniform cross-sectional shape despite the flow state varying in the direction along the rotating shaft, the blade shape does not match the flow, which results in decreased efficiency and airflow disturbance, thus leading to increased fan input power and noise.

Various proposals have thus been made for improved fan efficiency and reduced noise. PTL 1 discloses a multi-blade centrifugal fan including blades curved in a concave shape on the pressure side and satisfying $\beta 2<\beta 3$, where $\beta 2$ is a middle angle between a tangent to a circle whose radius is a line segment joining the middle point in the middle portion between the inner and outer ends of each blade and the center of the fan and the surface of the blade at the middle point, and $\beta 3$ is an exit angle between a tangent to a circle whose radius is a line segment joining the exit point of the outer end of each blade and the center of the fan and the blade surface at the exit point, which is intended to relatively increase the static pressure component for reduced noise and increased fan efficiency.

In addition, PTL 2 discloses a multi-blade centrifugal fan including blades having a tapered portion formed at least at one end of an inner edge (leading edge) thereof in the axial direction such that the inner diameter thereof increases from the other end to the one end in the axial direction, the tapered portion being located forward in the rotational direction and having an entrance angle of 55° to 76° for increased work of the impeller, improved efficiency, and reduced noise. In addition, PTL 3 discloses a multi-blade centrifugal fan including blades curved in a concave shape on the pressure side such that they are backward-swept near the leading edge thereof and are forward-swept near the trailing edge thereof, wherein the sum of an entrance angle $\beta 1$ and an angle $\beta' 2$ is set to less than 80° to reduce the noise level without a decrease in the volume of air, where $\beta 1$ is the entrance angle of the blades, $\beta 2$ is the exit angle of the blades, and $\beta' 2$ is the difference obtained by subtracting the exit angle $\beta 2$ from an angle of 180°.

CITATION LIST

Patent Literature

{PTL 1}
Publication of Japanese Patent No. 3387987
{PTL 2}
Japanese Unexamined Patent Application, Publication No. 2006-200525
{PTL 3}
Japanese Unexamined Patent Application, Publication No. 2006-336558

SUMMARY OF INVENTION

Technical Problem

The related art techniques as disclosed in the above patent literature attempt to reduce inflow loss and to improve pressure characteristics at the exit portions of the blades for reduced noise and improved efficiency by curving the blade shape in a concave shape on the pressure side such that they are backward-swept near the leading edge thereof and are forward-swept near the trailing edge thereof, by reducing the entrance angle thereof, by forming the trailing edge in a convex shape on the pressure side, or by gradually increasing the inner diameter of the leading edges of the cascade of blades from the hub toward the shroud so that an intake flow taken in in the direction along the rotating shaft is taken in at an angle as close to a right angle as possible. These techniques, however, cannot make the intake flow, which tends to concentrate at a position slightly closer to the hub than the center of the blades in the spanwise direction, uniform in the spanwise direction of the blades, and particularly, are insufficient in improving the flow near the shroud, and there is a need to further alleviate decreased efficiency and increased noise due to, for example, flow separation and backflow at that portion.

An object of the present invention, which has been made in light of the foregoing circumstances, is to provide a multi-blade centrifugal fan including blades shaped to better match a flow in order to make the flow uniform in the spanwise direction of the blades so that they can inhibit flow disturbance to reduce fan input power and noise for increased efficiency and reduced noise, and also to provide an air conditioner using such a multi-blade centrifugal fan.

Solution to Problem

To solve the problems discussed above, the multi-blade centrifugal fan and the air conditioner using the multi-blade centrifugal fan according to the present invention employ the following solutions.

Specifically, a multi-blade centrifugal fan according to a first aspect of the present invention is a multi-blade centrifugal fan including an impeller rotatably disposed in a scroll-shaped casing and composed of a disc-shaped hub, a plurality of blades arranged on a periphery of the hub, and an annular shroud disposed at opposite ends of the blades from the hub. The blades are curved in a concave shape on a pressure side in a cross-section perpendicular to a rotating shaft of the impeller and have a curved shape that is backward-swept near a leading edge thereof and that is forward-swept near a trailing edge thereof. The inner diameter of the cascade of blades increases gradually from the hub toward the shroud, and the diameter of a maximum-curvature position where the curvature of the curved shape is maximized increases gradually from the hub toward the shroud.

In the multi-blade centrifugal fan according to the first aspect of the present invention, because the blades of the impeller are curved in a concave shape on the pressure side in a cross-section perpendicular to the rotating shaft of the impeller and have a curved shape that is backward-swept near the leading edge thereof and that is forward-swept near the trailing edge thereof, the inner diameter of the cascade of blades increases gradually from the hub toward the shroud, and the diameter of the maximum-curvature position where the curvature of the curved shape is maximized increases gradually from the hub toward the shroud, an intake flow taken in in the direction along the rotating shaft of the impeller can be taken in at an angle closer to a right angle with respect to the leading edge line of the blades, which have a curved shape that is backward-swept near the leading edge thereof and that is forward-swept near the trailing edge thereof, thus reducing the inflow loss of the intake flow. In addition, because the diameter of the maximum-curvature position of the blades becomes smaller toward the hub, the pressure rise starting position between the blades is shifted upstream near the hub, and accordingly the interblade pressure rises earlier near the hub. This forms a pressure gradient extending from the hub toward the shroud between the blades to tilt the flow between the blades toward the shroud, thus making the entire flow uniform in the spanwise direction of the blades. Thus, the blades can be shaped to better match the flow, which inhibits a flow disturbance through the impeller to reduce fan input power and noise, thus increasing the performance and efficiency of the multi-blade centrifugal fan and reducing noise therefrom.

Preferably, in the multi-blade centrifugal fan according to the first aspect of the present invention, if the inner diameter of the cascade of blades near the hub of the impeller is D1*h*, the outer diameter of the cascade of blades near the hub is D2*h*, the diameter of the maximum-curvature position near the hub is D3*h*, the inner diameter of the cascade of blades near the shroud is D1*t*, the outer diameter of the cascade of blades near the shroud is D2*t*, and the diameter of the maximum-curvature position near the shroud is D3*t*, then the inner diameter D1*h* near the hub is smaller than the inner diameter D1*t* near the shroud, and (D3*t*−D1*t*)/(D2*t*−D1*t*) near the shroud is larger than (D3*h*−D1*h*)/(D2*h*−D1*h*) near the hub.

With this structure, if the inner diameter of the cascade of blades near the hub of the impeller is D1*h*, the outer diameter of the cascade of blades near the hub is D2*h*, the diameter of the maximum-curvature position near the hub is D3*h*, the inner diameter of the cascade of blades near the shroud is D1*t*, the outer diameter of the cascade of blades near the shroud is D2*t*, and the diameter of the maximum-curvature position near the shroud is D3*t*, then the inner diameter D1*h* near the hub is smaller than the inner diameter D1*t* near the shroud, and (D3*t*-D1*t*)/(D2*t*-D1*t*) near the shroud is larger than (D3*h*-D1*h*)/(D2*h*-D1*h*) near the hub; therefore, the diameter of the maximum-curvature position can be varied with the variation in the inner diameter of the cascade of blades so that the diameter of the maximum-curvature position of the blades becomes smaller toward the hub, and accordingly the pressure rise starting position between the blades is shifted upstream near the hub. This allows the interblade pressure to rise earlier near the hub and forms a pressure gradient extending from the hub toward the shroud between the blades to tilt the flow between the blades toward the shroud, thus making the entire flow uniform in the spanwise direction of the blades, which inhibits a flow disturbance to reduce the fan input power and noise, thus increasing the performance and efficiency of the multi-blade centrifugal fan and reducing the noise therefrom.

Preferably, in the multi-blade centrifugal fan according to the first aspect of the present invention, the diameter of the maximum-curvature position changes substantially linearly from the hub toward the shroud.

With this structure, because the diameter of the maximum-curvature position changes substantially linearly from the hub toward the shroud, the pressure rise starting position between the blades is shifted upstream near the hub and, at the same time, changes smoothly and substantially linearly from the hub toward the shroud. Accordingly, a substantially linear pressure gradient can be formed between the blades from the hub toward the shroud to make the flow more uniform in the spanwise direction of the blades, thus further increasing the performance and efficiency of the multi-blade centrifugal fan.

Preferably, in the multi-blade centrifugal fan according to the first aspect of the present invention, if the radius of curvature near the leading edge, where the blades are backward-swept, is r1, the radius of curvature near the trailing edge, where the blades are forward-swept, is r2, and the radius of curvature of the maximum-curvature position is r3 in a cross-section perpendicular to the rotating shaft of the impeller, then the radii of curvature r1, r2, and r3 satisfy r3<r1 and r3<r2.

With this structure, if the radius of curvature near the leading edge, where the blades are backward-swept, is r1, the radius of curvature near the trailing edge, where the blades are forward-swept, is r2, and the radius of curvature of the maximum-curvature position is r3 in a cross-section perpendicular to the rotating shaft of the impeller, then the radii of curvature r1, r2, and r3 satisfy r3<r1 and r3<r2; therefore, at entrance and exit portions of the blades, where flow separation tends to occur, the radii of curvature r1 and r2 near the leading edge, where the blades are backward-swept, and the trailing edge, where the blades are forward-swept, each corresponding to either portion, are made larger to reduce the load on the entrance and exit portions of the blades, thereby stabilizing the flow. In addition, the entrance angle at the leading edge, where the blades are backward-swept, can be adjusted to the flow direction without reducing the spacing between the blades so that the intake flow can be smoothly taken in. This inhibits a flow disturbance at the entrance and exit portions of the blades for increased efficiency and reduced noise.

Preferably, in the above multi-blade centrifugal fan, the radii of curvature r1, r2, and r3 satisfy r3<r1<r2.

With this structure, because the radii of curvature r1, r2, and r3 satisfy r3<r1<r2, that is, because the radius of curvature r2 near the trailing edges of the blades, where the flow has a higher velocity, is the largest, the load on the exit portions of the blades, where separation tends to occur, can be further reduced to further stabilize the flow. This inhibits a flow disturbance at the exit portions of the blades for further increased efficiency and reduced noise.

Preferably, in the multi-blade centrifugal fan according to the first aspect of the present invention, the entrance angle βb1 of the blades is 50° or less in a cross-section perpendicular to the rotating shaft of the impeller.

With this structure, because the entrance angle βb1 of the blades is 50° or less in a cross-section perpendicular to the rotating shaft of the impeller, the entrance angle βb1 of the blades matches a typical relative inflow angle, thereby reducing the inflow loss of the intake flow. This improves the blowing efficiency of the multi-blade centrifugal fan for increased performance.

Preferably, in the above multi-blade centrifugal fan, the entrance angle $\beta b1$ of the blades increases gradually from the hub toward the shroud.

With this structure, because the entrance angle $\beta b1$ increases gradually from the hub toward the shroud, the difference (angle of deflection) between the entrance angle and the exit angle decreases gradually from the hub toward the shroud, so that the flow can be stabilized without abrupt deflection near the shroud, where the difference between the inner and outer diameters decreases as the inner diameter increases, thus allowing for increased blowing efficiency and reduced noise.

Preferably, in the multi-blade centrifugal fan according to the first aspect of the present invention, the number of blades on the impeller, N, is $15 \leq N \leq 30$.

With this structure, because the number of blades, N, is $15 \leq N \leq 30$, the friction loss in the interblade channels can be controlled within an appropriate range, that is, a range of friction loss that is neither insufficient nor excessive, which allows the flow between the blades to be confined and blown out from the impeller in the centrifugal direction. This inhibits a backflow in the flow through the impeller for increased blowing efficiency and reduced noise.

Preferably, in the multi-blade centrifugal fan according to the first aspect of the present invention, the maximum-curvature position of the blades is more advanced in a rotational direction near the shroud than near the hub in a cross-section perpendicular to the rotating shaft of the impeller.

With this structure, because the maximum-curvature position of the blades is more advanced in the rotational direction near the shroud than near the hub in a cross-section perpendicular to the rotating shaft of the impeller, the force of the blades can be increased near the shroud, where a backflow tends to occurs. This inhibits a backflow in the flow near the shroud for increased blowing efficiency and reduced noise.

Preferably, in the above multi-blade centrifugal fan, the exit angle $\beta b2$ of the blades increases gradually from the hub toward the shroud in a cross-section perpendicular to the rotating shaft of the impeller.

With this structure, because the exit angle $\beta b2$ of the blades increases gradually from the hub toward the shroud in a cross-section perpendicular to the rotating shaft of the impeller, the force of the blades can be further increased near the shroud, where a backflow tends to occurs. This inhibits a backflow in the flow near the shroud for further increased blowing efficiency and reduced noise.

Preferably, in the multi-blade centrifugal fan according to the first aspect of the present invention, if the outer diameter of the cascade of blades near the hub of the impeller is $D2h$ and the outer diameter of the cascade of blades near the shroud is $D2t$, then the outer diameters $D2h$ and $D2t$ satisfy $D2h \leq D2t$.

With this structure, if the outer diameter of the cascade of blades near the hub of the impeller is $D2h$ and the outer diameter of the cascade of blades near the shroud is $D2t$, then the outer diameters $D2h$ and $D2t$ satisfy $D2h \leq D2t$; therefore, the exit peripheral velocity of the blades is higher near the shroud than near the hub, and accordingly the pressure rise is larger near the shroud. This increases the blowing efficiency near the shroud for further increased efficiency and performance.

Preferably, in the multi-blade centrifugal fan according to the first aspect of the present invention, a stagger angle $\gamma$ of the blades decreases gradually from the hub toward the shroud in a cross-section perpendicular to the rotating shaft of the impeller.

With this structure, because the stagger angle $\gamma$ of the blades decreases gradually from the hub toward the shroud in a cross-section perpendicular to the rotating shaft of the impeller, the radii of curvature r1, r2, and r3 of the blades near the leading edge, near the trailing edge, and at the maximum-curvature position in a cross-section perpendicular to the rotating shaft of the impeller each vary more smoothly from the hub toward the shroud if, as noted above, the entrance angle $\beta b1$ increases gradually from the hub toward the shroud, or if the exit angle $\beta b2$ increases gradually from the hub toward the shroud. This inhibits a flow disturbance to reduce the fan input power and noise, thus further increasing the performance and efficiency of the multi-blade centrifugal fan.

Preferably, in the multi-blade centrifugal fan according to the first aspect of the present invention, a trailing edge line of the blades is tilted in a direction opposite to a rotational direction from the hub toward the shroud.

With this structure, because the trailing edge line of the blades is tilted in the direction opposite to the rotational direction from the hub toward the shroud, the direction of the action of the blade force on the flow blown out from the trailing edges of the blades is directed toward the shroud, which inhibits flow concentration near the hub and allows the interblade flow to be directed toward the shroud, thus making the entire flow uniform in the spanwise direction of the blades. This increases the blowing efficiency near the shroud, thus further increasing the efficiency and performance of the multi-blade centrifugal fan and reducing the noise therefrom.

Preferably, in the above multi-blade centrifugal fan, if a tilt angle between the trailing edge line of the blades and the rotating shaft of the impeller is $\xi te$, the tilt angle $\xi te$ is substantially constant from the shroud toward the hub.

With this structure, if the tilt angle between the trailing edge line of the blades and the rotating shaft of the impeller is $\xi te$, the tilt angle $\xi te$ is substantially constant from the shroud toward the hub; therefore, the direction of the action of the blade force on the flow blown out from the trailing edges of the blades is directed toward the shroud substantially uniformly over the entire region in the direction along the rotating shaft, which corrects flow concentration near the hub and allows the interblade flow to be tilted toward the shroud, thus making the entire flow uniform in the spanwise direction of the blades. This increases the blowing efficiency near the shroud, thus further increasing the efficiency and performance of the multi-blade centrifugal fan and reducing the noise therefrom.

Preferably, in the above multi-blade centrifugal fan, if a tilt angle between the trailing edge line of the blades and the rotating shaft of the impeller is $\xi te$, the tilt angle $\xi te$ increases gradually from the shroud toward the hub.

With this structure, if the tilt angle between the trailing edge line of the blades and the rotating shaft of the impeller is $\xi te$, the tilt angle $\xi te$ increases gradually from the shroud toward the hub; therefore, the direction of the action of the blade force on the flow blown out from the trailing edges of the blades is directed more toward the shroud near the hub, where the flow tends to concentrate, which corrects flow concentration near the hub and allows the interblade flow to be tilted toward the shroud, thus making the entire flow uniform in the spanwise direction of the blades. This increases the blowing efficiency near the shroud, thus further increasing the efficiency and performance of the multi-blade centrifugal fan and reducing the noise therefrom.

Preferably, in the above multi-blade centrifugal fan, if a tilt angle between the trailing edge line of the blades and the rotating shaft of the impeller is ξte, the tilt angle ξte is substantially constant near the shroud, decreases gradually therefrom to a central region in a direction along the rotating shaft of the impeller, and increases gradually therefrom toward the hub.

With this structure, if the tilt angle between the trailing edge line of the blades and the rotating shaft of the impeller is ξte, the tilt angle ξte is substantially constant near the shroud, decreases gradually therefrom to the central region in the direction along the rotating shaft of the impeller, and increases gradually therefrom toward the hub; therefore, the direction of the action of the blade force on the flow blown out from the trailing edges of the blades is directed in the direction along the shroud near the shroud, remains in that state therefrom to the central region, and is directed more toward the shroud near the hub, where the flow tends to concentrate, which corrects flow concentration near the hub and allows the interblade flow to be tilted toward the shroud, thus making the entire flow uniform in the spanwise direction of the blades. This increases the blowing efficiency near the shroud without unnecessarily increasing the length of the blades, thus further increasing the efficiency and performance of the multi-blade centrifugal fan and reducing the noise therefrom.

Preferably, in the multi-blade centrifugal fan according to the first aspect of the present invention, the outer diameter of the shroud of the impeller is smaller than the outer diameter of the trailing edges of the blades, and portions near the trailing edges of the blades do not overlap the shroud in a direction along the rotating shaft of the impeller.

With this structure, because the outer diameter of the shroud of the impeller is smaller than the outer diameter of the trailing edges of the blades, and the portions near the trailing edges of the blades do not overlap the shroud in the direction along the rotating shaft of the impeller, an impeller including blades whose trailing edge line is tilted in the direction opposite to the rotational direction from the hub toward the shroud can be relatively easily formed as one piece by injection molding of a plastic material using different mold halves for the portions near the trailing edges of the blades and the portions of the blades overlapping the shroud in the direction along the rotating shaft. Thus, a one-piece plastic impeller can be formed at low cost by injection molding using a pair of mold halves that are separable in the direction along the rotating shaft.

Preferably, in the multi-blade centrifugal fan according to the first aspect of the present invention, the outer diameter of the hub of the impeller is larger than or equal to the outer diameter of the trailing edges of the blades, and ends of the blades near the hub are fixed to the hub from the leading edge to the trailing edge by joining or fitting.

With this structure, because the outer diameter of the hub of the impeller is larger than or equal to the outer diameter of the trailing edges of the blades, and the ends of the blades near the hub are fixed to the hub from the leading edge to the trailing edge by joining or fitting, an impeller including blades having a large exit angle can be prevented from being deformed in the blades thereof due to centrifugal force or fluid force by fixing the ends of the blades on the hub side to a hub having an outer diameter larger than or equal to the outer diameter of the blades by joining or fitting. This allows the exit angle of the blades to be increased and, particularly, inhibits a backflow in the flow near the shroud for further increased efficiency and reduced noise.

One of the above multi-blade centrifugal fans is installed as an air blower fan in an air conditioner according to a second aspect of the present invention.

Because the air blower fan used for the air conditioner according to the second aspect of the present invention is one of the above multi-blade centrifugal fans, the multi-blade centrifugal fan, which has increased performance and efficiency and reduced noise, as noted above, can be similarly installed as an air blower fan in an air conditioner for use in, for example, a building or automobile to increase the performance and efficiency of the air conditioner and to reduce noise therefrom, thus increasing its commercial value.

Advantageous Effects of Invention

For the multi-blade centrifugal fan according to the first aspect of the present invention, in which the inner diameter of the cascade of blades increases gradually from the hub toward the shroud, the intake flow taken into the impeller in the direction along the rotating shaft can be taken in at an angle closer to a right angle with respect to the leading edge line of the blades, thus reducing the inflow loss of the intake flow. In addition, because the diameter of the maximum-curvature position of the blades becomes smaller toward the hub, the pressure rise starting position between the blades is shifted upstream near the hub, and accordingly the interblade pressure rises earlier near the hub, which forms a pressure gradient extending from the hub toward the shroud between the blades to tilt the flow between the blades toward the shroud, thus making the entire flow uniform in the spanwise direction of the blades; thus, the blades can be shaped to better match the flow, which inhibits a flow disturbance through the impeller to reduce the fan input power and noise, thus increasing the performance and efficiency of the multi-blade centrifugal fan and reducing the noise therefrom.

For the air conditioner according to the second aspect of the present invention, the multi-blade centrifugal fan, which has increased performance and efficiency and reduced noise, as noted above, can be similarly installed as an air blower fan in an air conditioner for use in, for example, a building or automobile to increase the performance and efficiency of the air conditioner and to reduce noise therefrom, thus increasing its commercial value.

DESCRIPTION OF EMBODIMENTS

Embodiments of the present invention will be described below with reference to the drawings.

{First Embodiment}

A first embodiment of the present invention will be described below using FIGS. 1 to 16.

Figure 1:
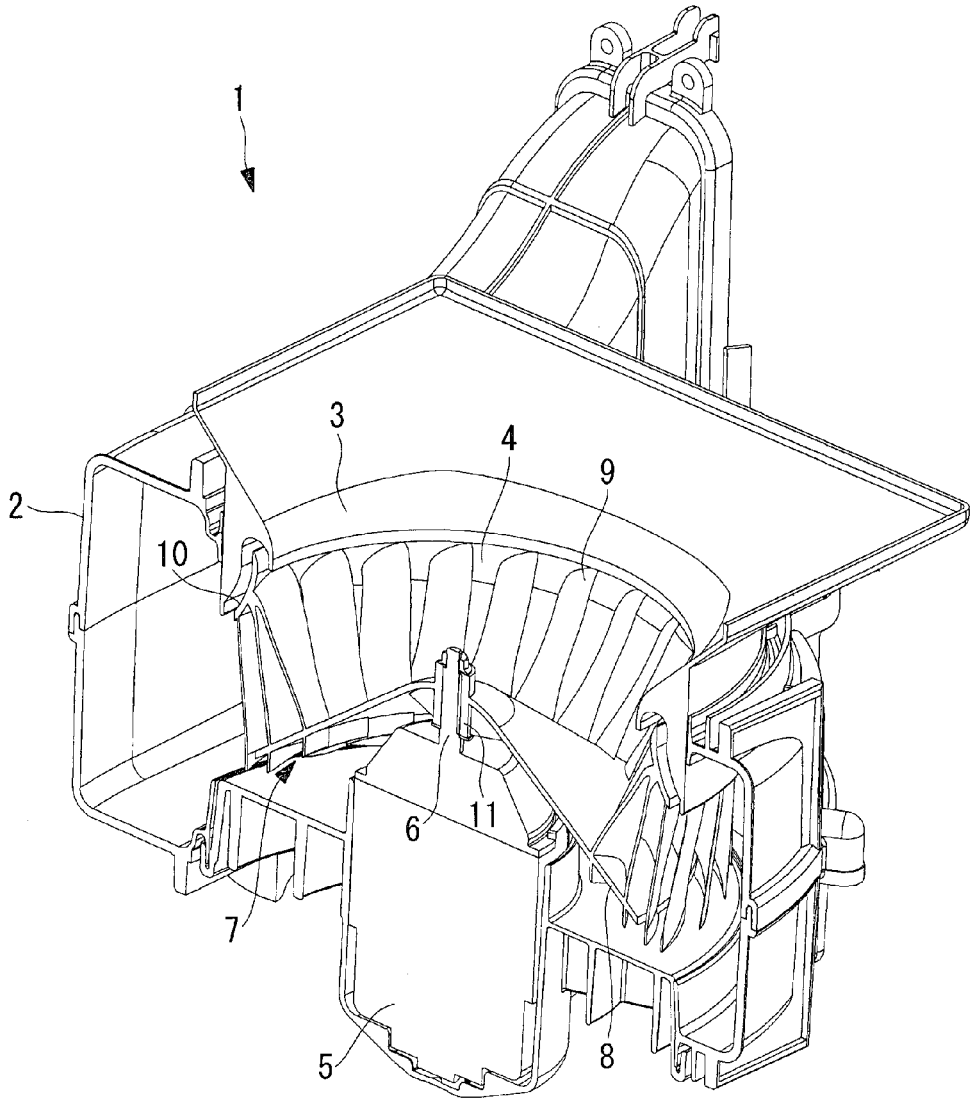
FIG. 1 is a perspective view of a multi-blade centrifugal fan according to a first embodiment of the present invention, shown as being cut along a meridian.
Figure 2:
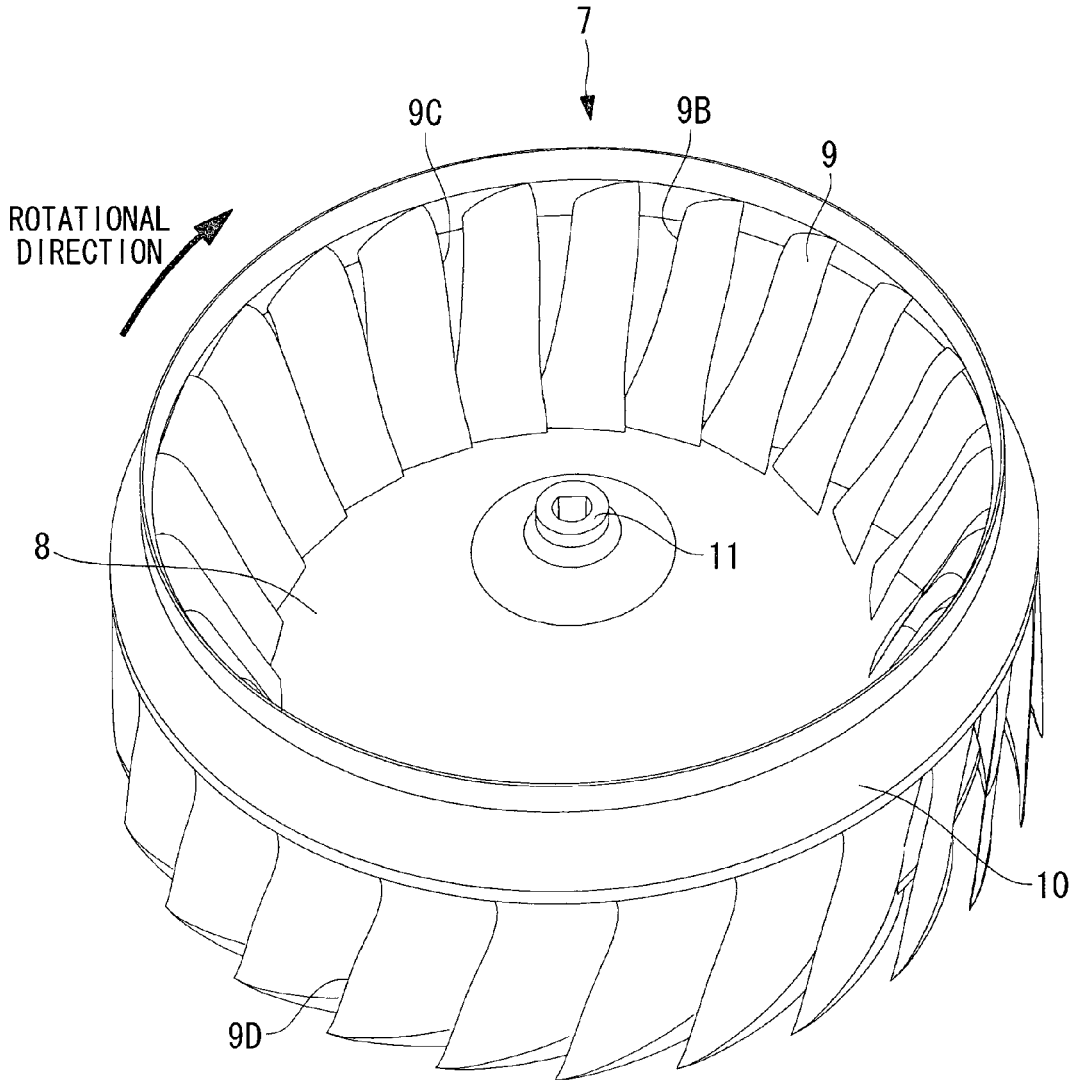
FIG. 2 is a perspective view of an impeller shown in FIG. 1.
Figure 3:
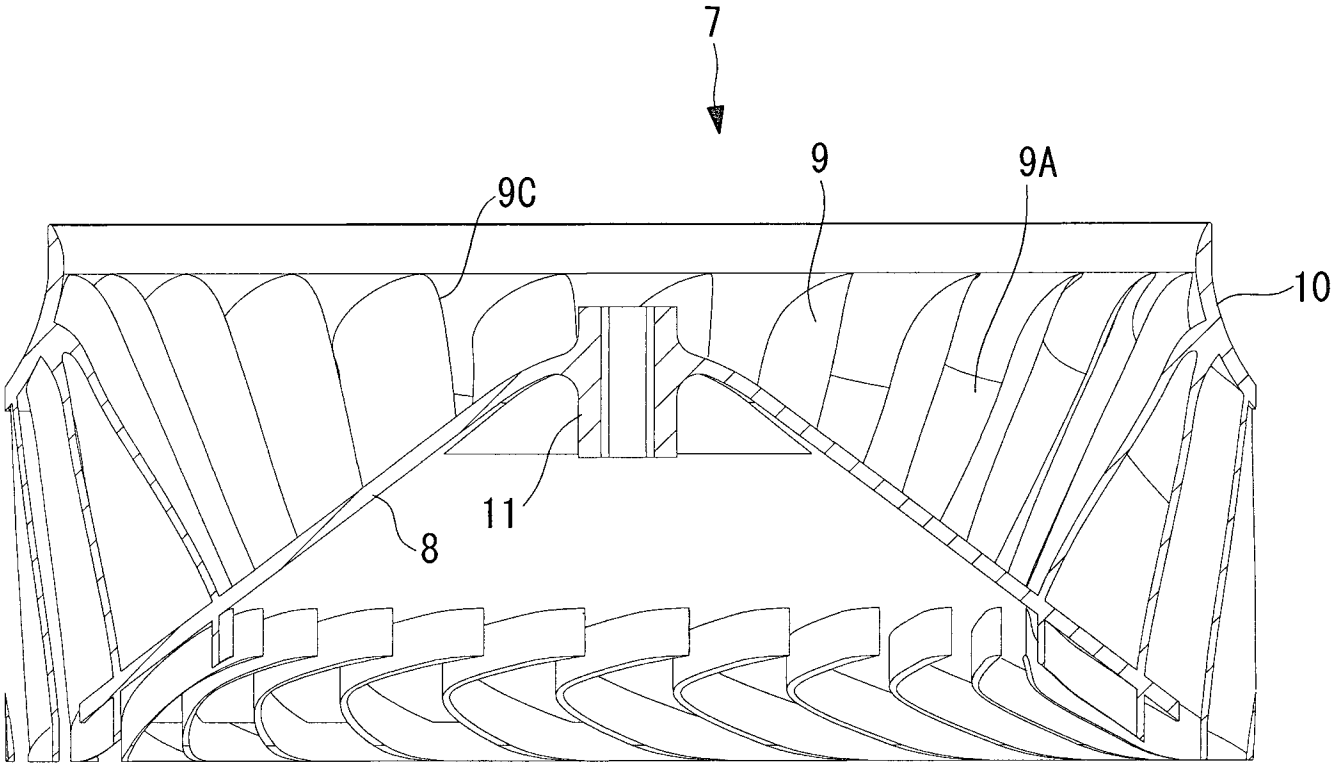
FIG. 3 is a longitudinal sectional view of the impeller shown in FIG. 2.
Figure 4:
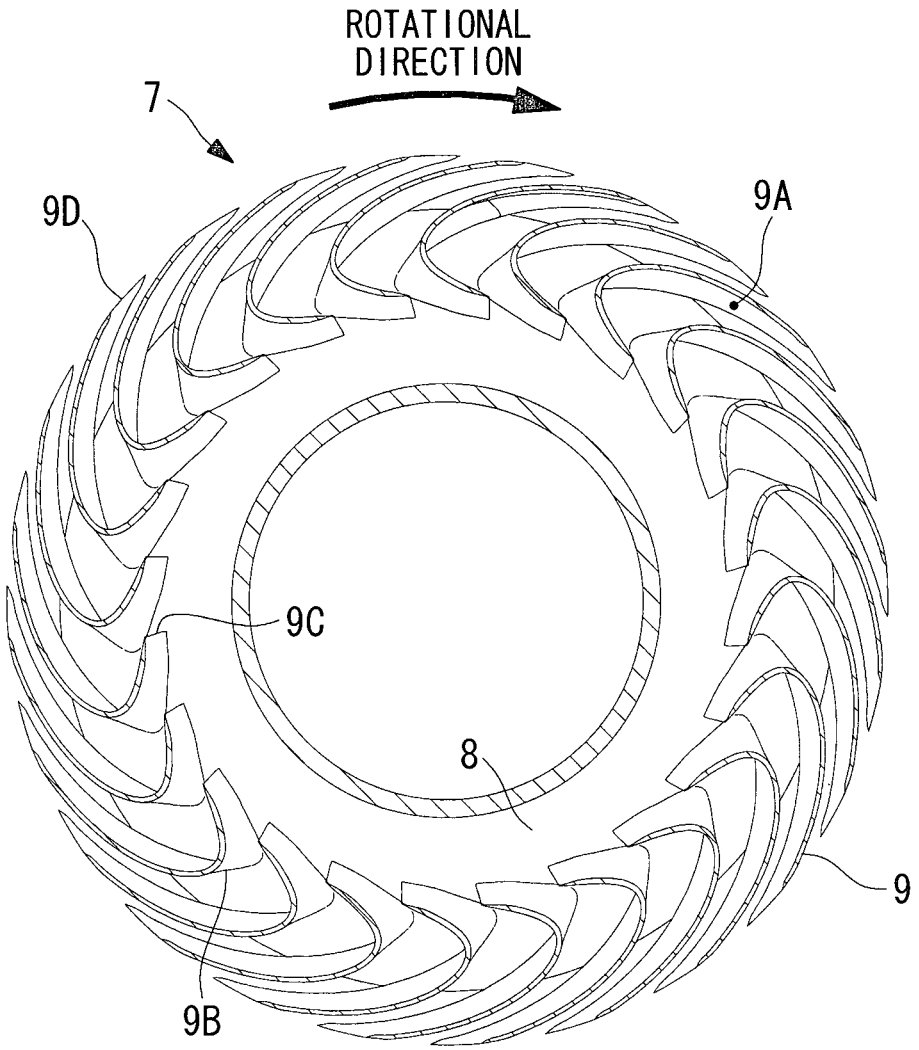
FIG. 4 is a cross-sectional view of the impeller shown in FIG. 2.

FIG. 1 illustrates a perspective view of a multi-blade centrifugal fan according to the first embodiment of the present invention, shown as being cut along a meridian. FIG. 2 illustrates a perspective view of an impeller thereof. FIG. 3 illustrates a longitudinal sectional view of the impeller. FIG. 4 illustrates a cross-sectional view of the impeller.

A multi-blade centrifugal fan 1 includes a scroll-shaped plastic casing 2.

The scroll-shaped casing 2 is formed by joining together a pair of upper and lower casings formed in a volute shape originating from a tongue and has a discharge port (not shown) extending tangentially from a volute end. The casing 2 has an air intake port 4 around which a bell mouth 3 is formed in a top surface thereof and a fan motor 5 mounted on a bottom surface thereof for rotating an impeller 7. The fan motor 5 has a rotating shaft 6 extending upward from the motor body.

Referring to FIGS. 2 to 4, the impeller 7 is composed of a disc-shaped hub (main plate) 8 whose center is convex on the intake side, a plurality of blades (also called blades, vanes, or the like) 9 arranged radially on the periphery of the hub 8, and an annular shroud 10 disposed at the opposite ends of the blades 9 from the hub 8. A boss 11 is disposed in the center of the hub 8 and is secured to the end of the rotating shaft 6 so that the impeller 7 is rotationally driven by the fan motor 5. The impeller 7 is made of plastic.

Figure 5:
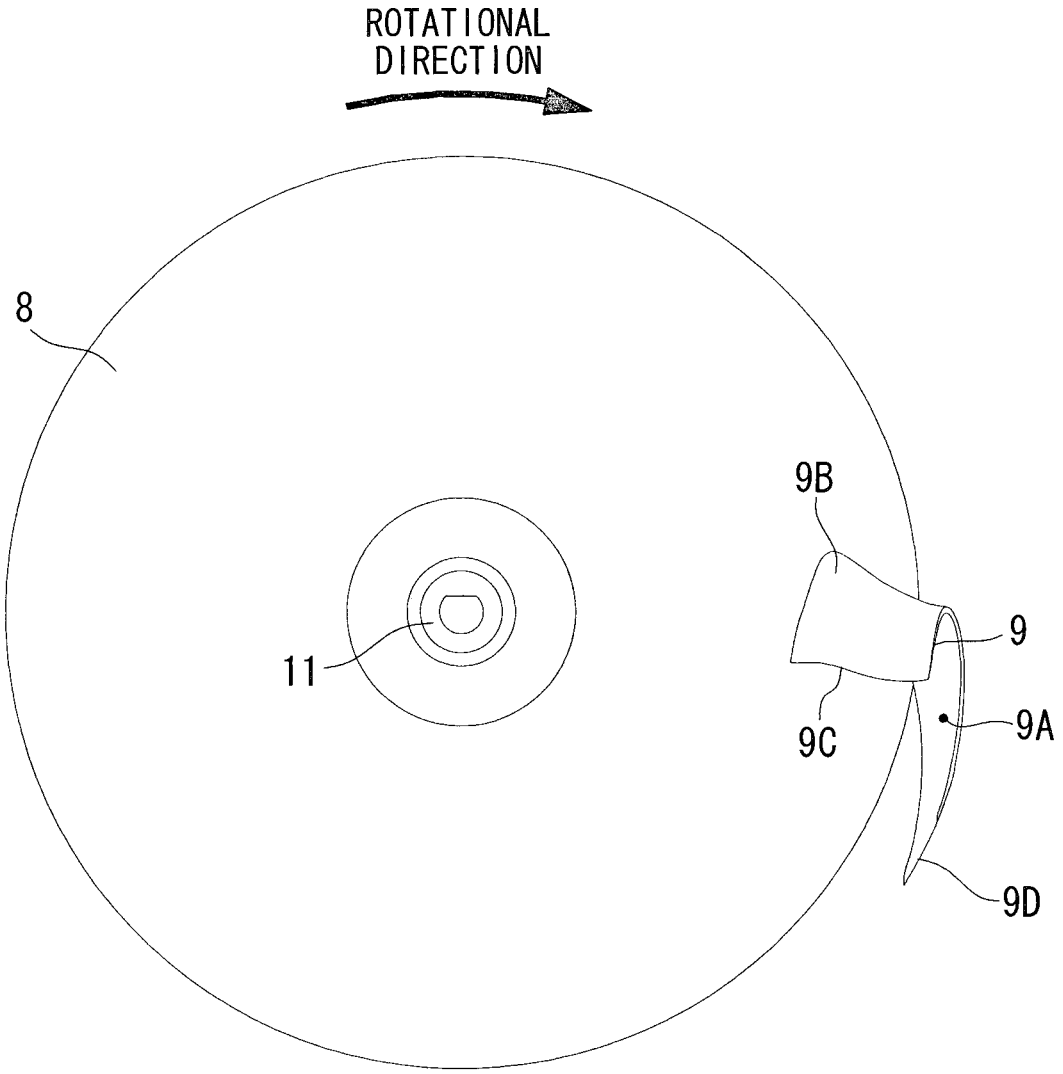
FIG. 5 is a plan view of a blade disposed on the periphery of the impeller shown in FIG. 2.
Figure 6:
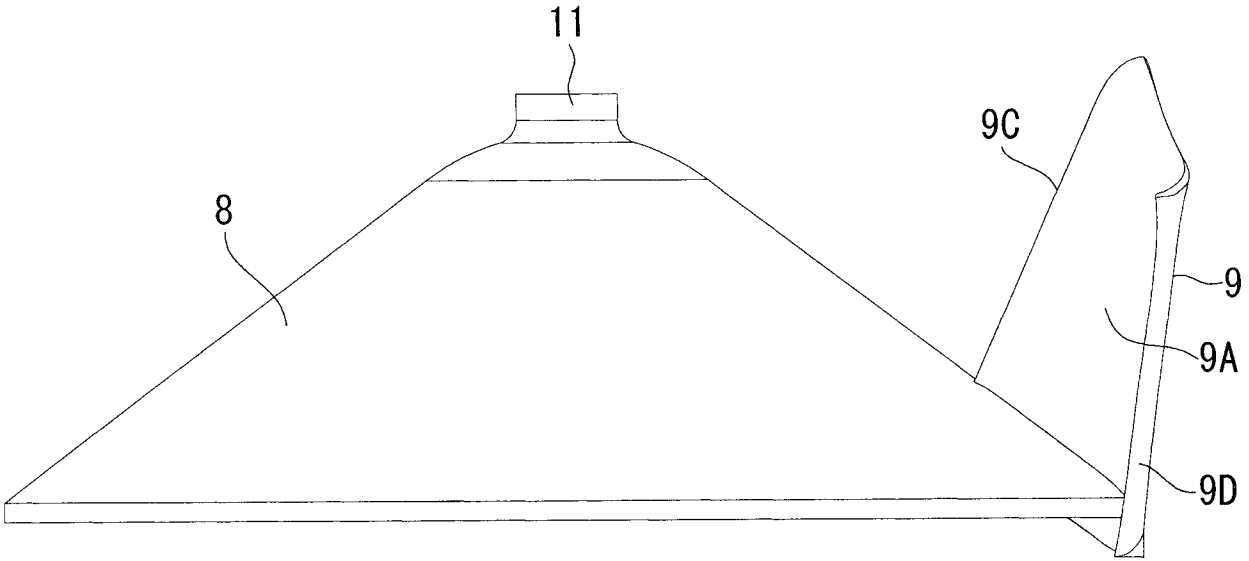
FIG. 6 is a front view of the blade shown in FIG. 5 as viewed from the bottom thereof.
Figure 7:
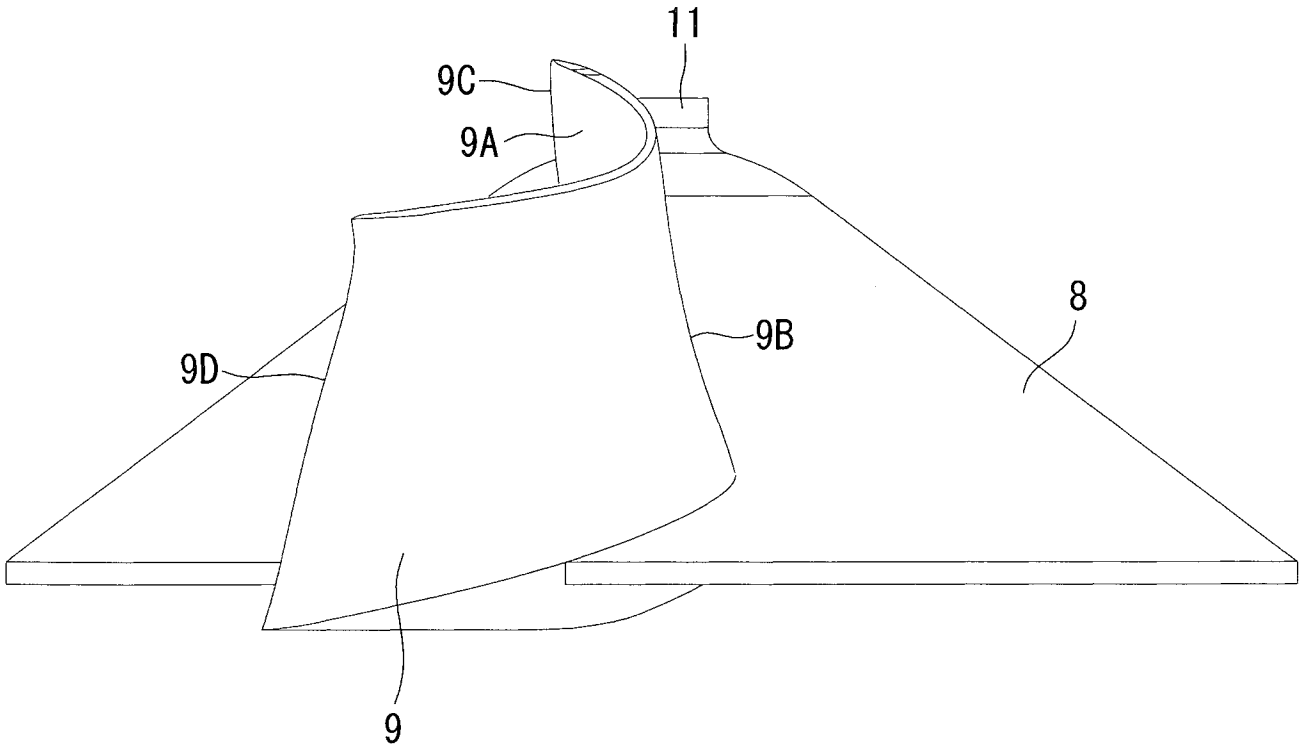
FIG. 7 is a side view of the blade shown in FIG. 5 as viewed from the right thereof.

As illustrated in FIG. 4, the blades 9 of the impeller 7 are curved in a concave shape on a pressure side 9A in a cross-section perpendicular to the rotating shaft 6 of the impeller 7, the blades 9 have a curved shape that is backward-swept near a leading edge 9C and is forward-swept near a trailing edge 9D with respect to a maximum-curvature position 9B, where the curvature is maximized, and the blades 9 are shaped such that the maximum-curvature position 9B is located rearmost in the rotational direction. FIGS. 5 to 7 illustrate three views (plan view, front view, and side view) of a blade 9 taken from those arranged on the periphery of the hub 8. The impeller 7 of this embodiment has 15 to 30 blades 9. That is, the number of blades 9 on the impeller 7, N, is $15 \leq N \leq 30$.

Figure 8:
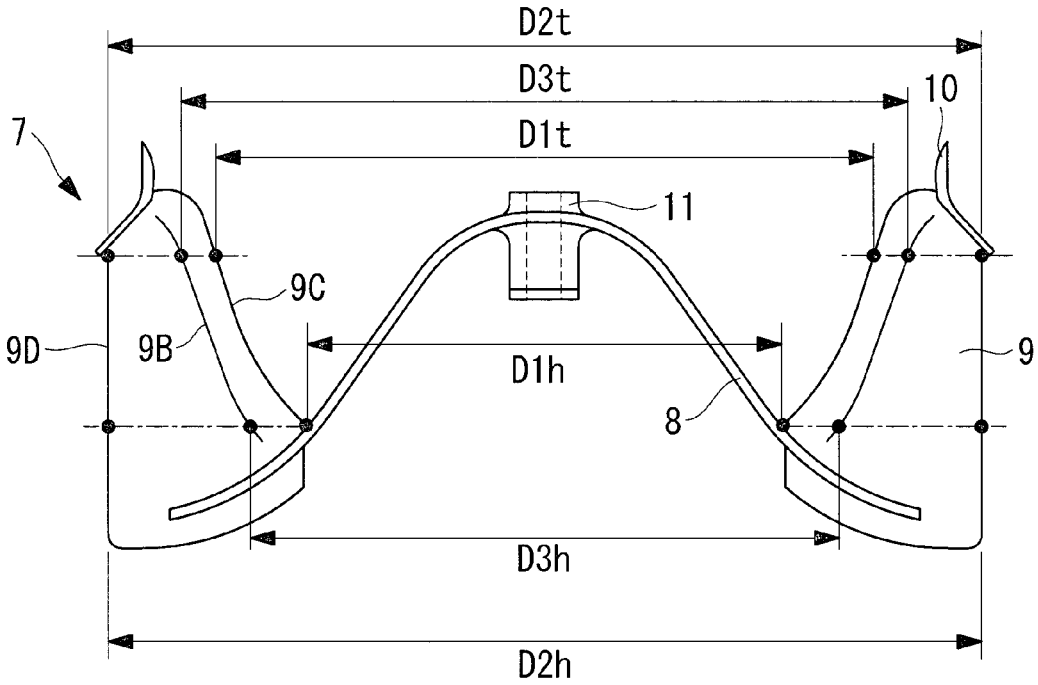
FIG. 8 is a schematic view showing the dimensions of various portions of the blades of the impeller shown in FIG. 2 in a cross-section taken along a meridian.

The inner diameter of the cascade of blades 9 defined by the leading edges thereof is tapered so as to gradually increase from the hub 8 toward the shroud 10 along the blades 9, and similarly, the diameter of the maximum-curvature position 9B is tapered so as to gradually increase from the hub 8 toward the shroud 10 along the blades 9. This structure will be described in detail using FIGS. 8 to 10. FIG. 8 illustrates a schematic view showing the dimensions of various parts of the blades in a meridional cross-section of the impeller 7, and FIG. 9 illustrates a schematic view showing the dimensions of various parts of the blades in a cross-section perpendicular to the rotating shaft.

Figure 9:
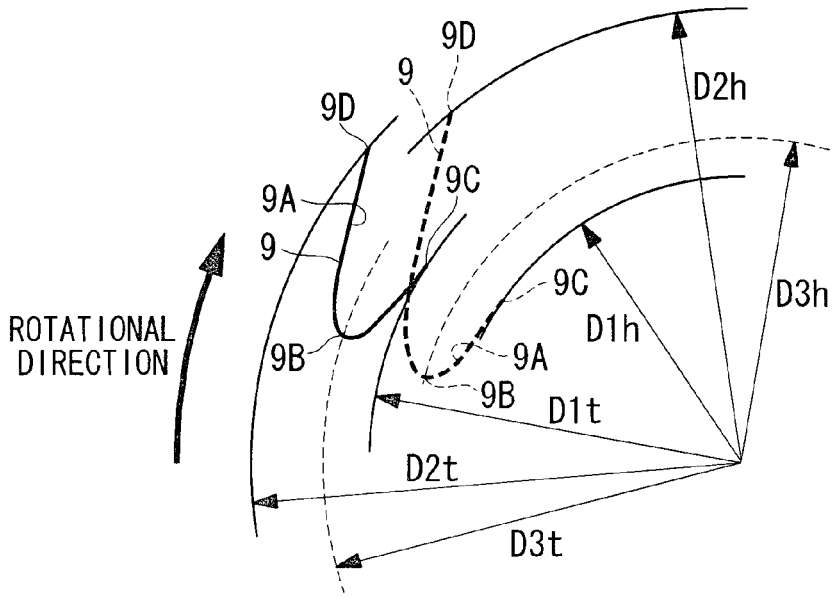
FIG. 9 is a schematic view showing the dimensions of various portions of the blades shown in FIG. 8 in a cross-section perpendicular to a rotating shaft.

As illustrated in FIGS. 8 and 9, if the inner diameter of the cascade of blades 9 near the hub 8 of the impeller 7 is D1*h*, the outer diameter of the cascade of blades 9 near the hub 8 is D2*h*, the diameter of the maximum-curvature position 9B near the hub 8 is D3*h*, the inner diameter of the cascade of blades 9 near the shroud 10 is D1*t*, the outer diameter of the cascade of blades 9 near the shroud 10 is D2*t*, and the diameter of the maximum-curvature position near the shroud 10 is D3*t*, then the inner diameter D1*h* of the cascade of blades near the hub 8 is smaller than the inner diameter D1*t* of the cascade of blades near the shroud 10 ($D1h<D1t$), and $(D3t-D1t)/(D2t-D1t)$ of the cascade of blades near the shroud 10 is larger than $(D3h-D1h)/(D2h-D1h)$ of the cascade of blades near the hub 8 ($(D3h-D1h)/(D2h-D1h)<(D3t-D1t)/(D2t-D1t)$).

Figure 10:
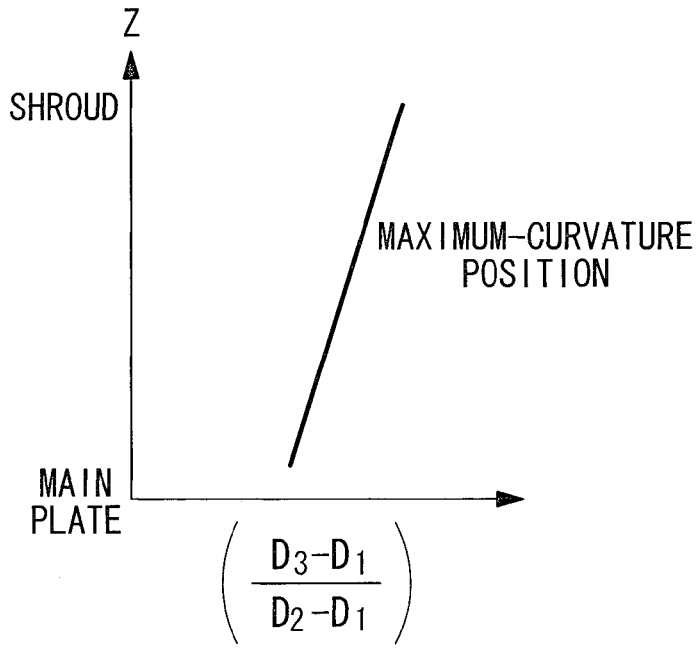
FIG. 10 is a graph showing the relationship between the positions of the maximum-curvature position of the blades of the impeller shown in FIG. 8 in the radial and axial directions.

Thus, as noted above, the inner diameter D1 of the cascade of blades 9 defined by the leading edges thereof is tapered so as to gradually increase from the hub 8 toward the shroud 10 along the blades 9, and similarly, the diameter D3 defined by the maximum-curvature position 9B is tapered so as to gradually increase from the hub 8 toward the shroud 10 along the blades 9. As illustrated in FIG. 10, additionally, the diameter D3 of the maximum-curvature position 9B changes substantially linearly from the hub 8 toward the shroud 10.

Figure 14:
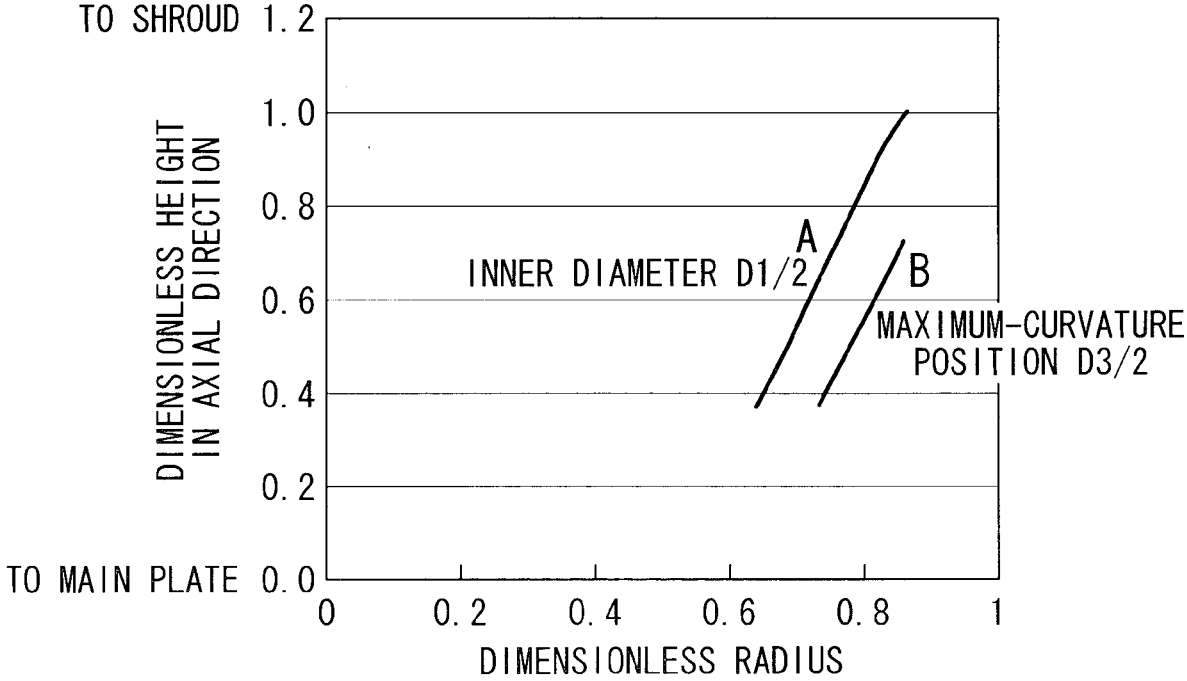
FIG. 14 is a graph showing the relationship between the radii of the leading edge of the cascade of blades and the maximum-curvature position of the blades and the height in the axial direction as dimensionless radius and height.

Similarly, as indicated by the solid line A (the inner diameter D1 of the cascade of blades) and the solid line B (the inner diameter D3 of the maximum-curvature position) in FIG. 14, the inner diameter D1 of the cascade of blades and the inner diameter D3 of the maximum-curvature position 9B gradually increase substantially in parallel with each other from the hub 8 toward the shroud 10 in the axial direction. In FIG. 14, an axial dimensionless height of 1.0 is substantially equivalent to 65 mm. Hereinafter this also applies to FIGS. 15, 16, 18, 20, and 21. In addition, as shown in FIG. 9, the outer diameter D2*t* of the cascade of blades near the shroud 10 is larger than or equal to the outer diameter D2*h* of the cascade of blades near the hub 8, namely, D2*h*≤D2*t*.

Figure 11:
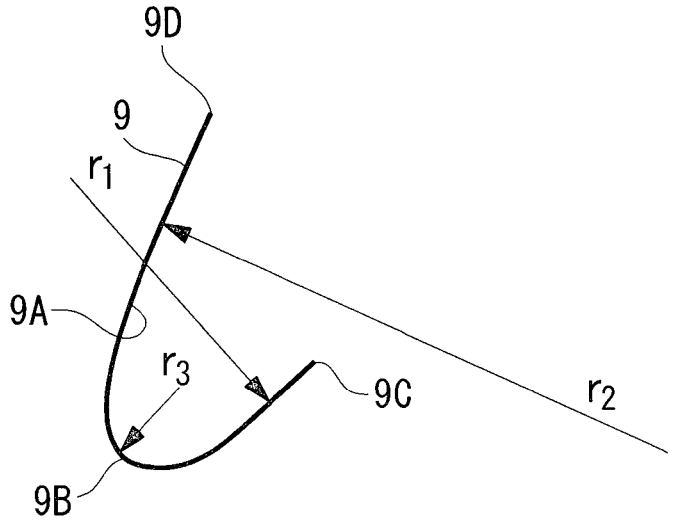
FIG. 11 is a schematic view showing the radii of curvature of various portions of the blades in the cross-section shown in FIG. 9.

Referring to FIG. 11, if the radius of curvature near the leading edge 9C, where the blades 9, which are curved in a concave shape on the pressure side 9A, as noted above, are backward-swept, is r1, the radius of curvature near the trailing edge 9D, where the blades 9 are forward-swept, is r2, and the radius of curvature of the maximum-curvature position 9B is r3 in a cross-section perpendicular to the rotating shaft 6 of the impeller 7, then the relationship between the radii of curvature r1, r2, and r3 of the blades 9 satisfies r3<r1 and r3<r2. More preferred is a shape satisfying r3<r1<r2, that is, a shape whose radius of curvature r2 near the trailing edge 9D is the largest.

Figure 12:
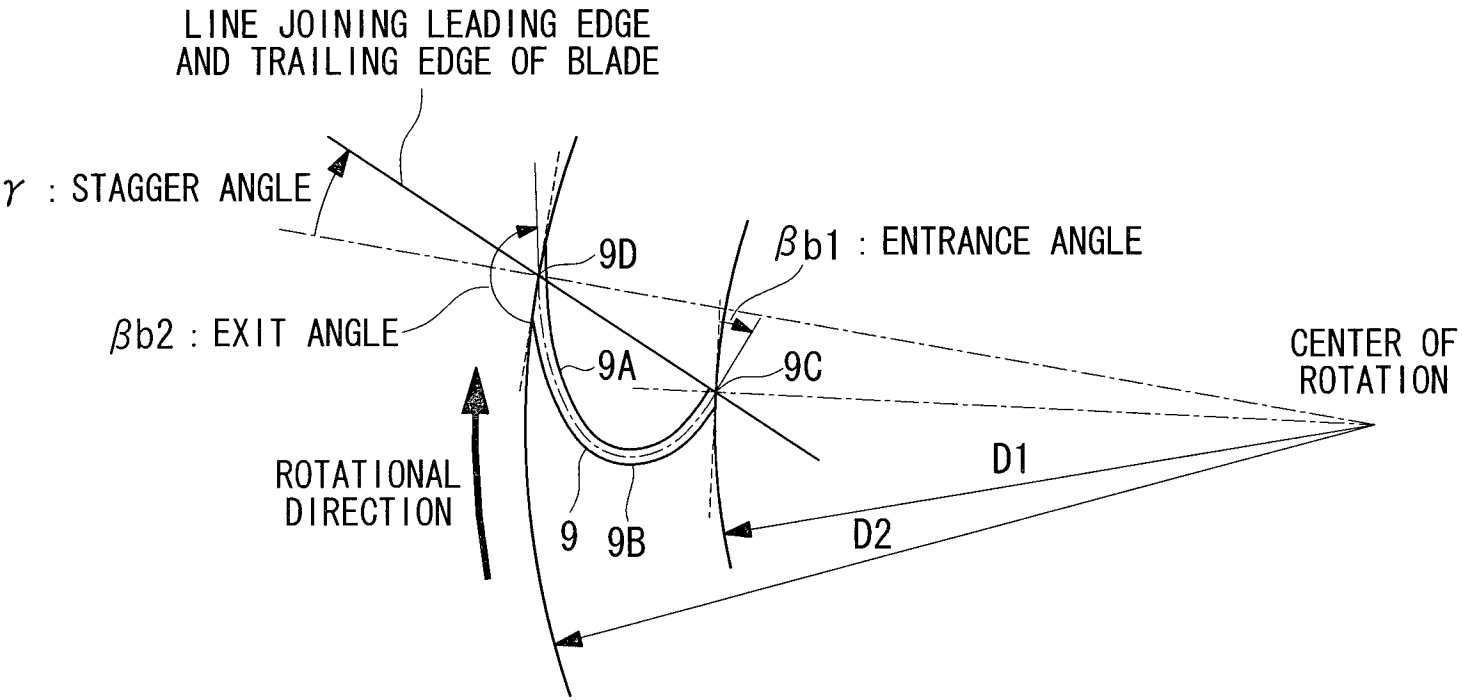
FIG. 12 is a schematic view showing the entrance angle, exit angle, and stagger angle of the blades in the cross-section shown in FIG. 9.
Figure 13:
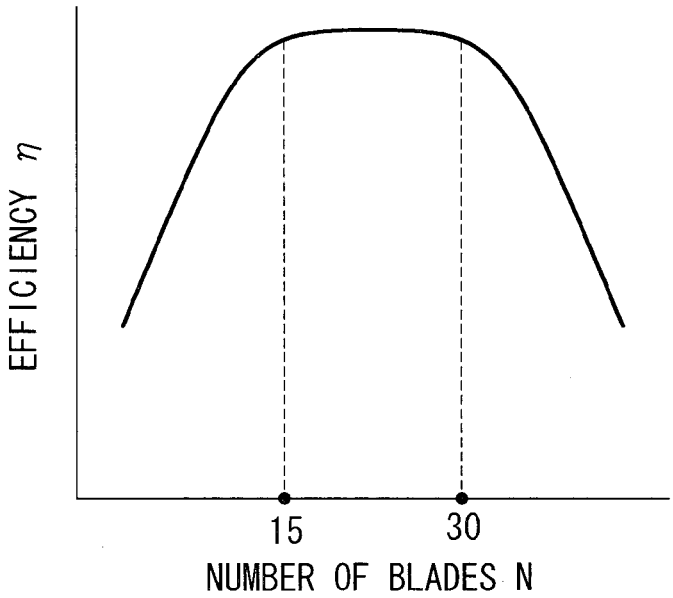
FIG. 13 is a graph showing the relationship between the number of blades on the impeller shown in FIG. 2 and efficiency.

Referring to FIG. 12, additionally, the entrance angle βb1 of the blades 9, that is, the angle βb1 between a tangent at the leading edge 9C of the blades 9 to a circle whose radius is a straight line joining the leading edge 9C and the center of the rotating shaft 6 and the surface of the blades 9 at the leading edge 9C in a cross-section perpendicular to the rotating shaft 6 of the impeller 7, is 50° or less, which matches a typical relative inflow angle of an intake flow. As indicated by the solid line D in FIG. 15, the entrance angle βb1 increases gradually from the hub 8 toward the shroud 10 within the range of 50° or less.

Figure 15:
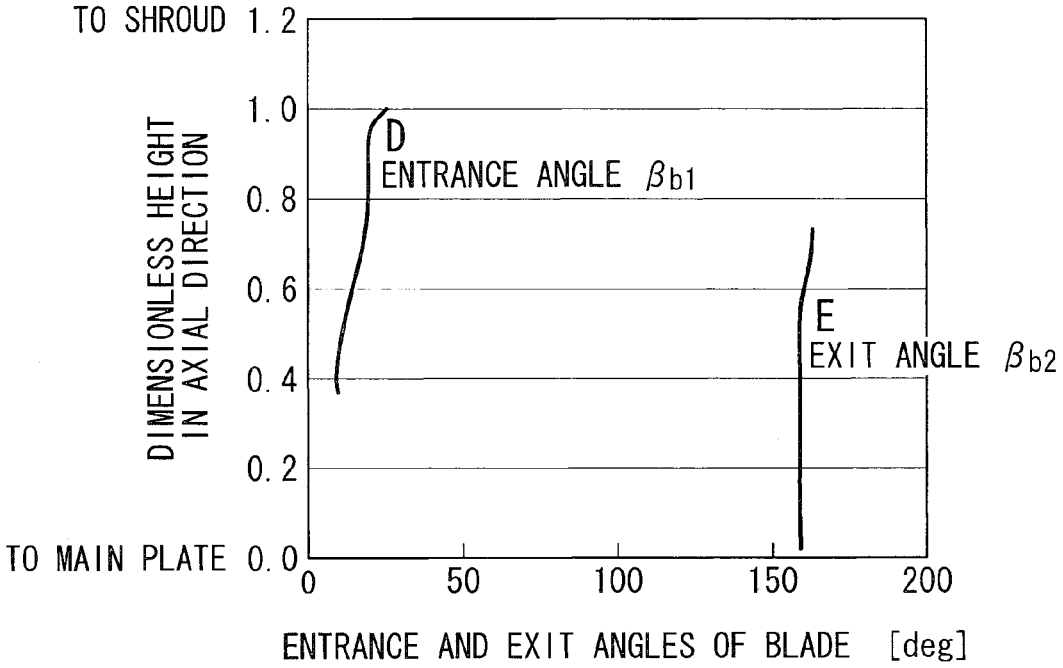
FIG. 15 is a graph showing the relationship between the entrance and exit angles of the blades and the height in the axial direction as dimensionless height.
Figure 16:
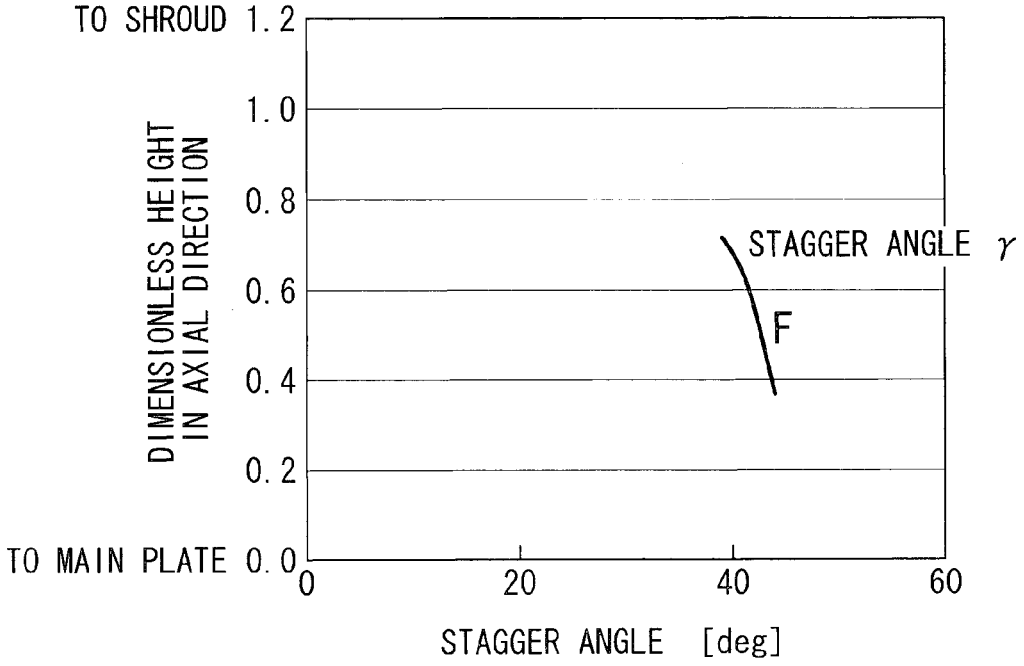
FIG. 16 is a graph showing the relationship between the stagger angle of the blades and the height in the axial direction as dimensionless height.

Similarly, the exit angle βb2 of the blades 9, that is, the angle βb2 between a tangent at the trailing edge 9D of the blades 9 to a circle whose radius is a straight line joining the trailing edge 9D and the center of the rotating shaft 6 and the surface of the blades 9 at the trailing edge 9D, is three or more times the entrance angle βb1, namely, 150° or more, and as indicated by the solid line E in FIG. 15, is substantially constant or increases slightly from the hub 8 toward the shroud 10 within the range of 50° or less. As indicated by the solid line F in FIG. 16, additionally, the stagger angle γ of the blades 9, that is, the angle γ between a straight line joining the trailing edge 9D of the blades 9 and the center of the rotating shaft 6 and a straight line joining the leading edge 9C and trailing edge 9D of the blades 9, decreases gradually from the hub 8 toward the shroud 10 within the range of about 35° to 45°.

With the structure described above, this embodiment provides the following advantageous effects.

In the above multi-blade centrifugal fan 1, as the impeller 7 is rotated via the rotating shaft 6 by driving the fan motor 5, an airflow taken in from the intake port 4 in the axial direction is pressurized through the impeller 7 while being deflected to the centrifugal direction and is blown out from the trailing edges 9D of the blades 9 into the scroll-shaped casing 2 in a tangential direction to a circle circumscribed around the impeller 7. The airflow then swirls along the inner surface of the casing 2 toward the discharge port while being pressurized and is discharged outside through the discharge port. During this operation, as noted above, the intake flow tends to be insufficiently deflected near the shroud 10 of the impeller 7, thus concentrating at a position slightly closer to the hub 8 than the center of the blades 9 in the spanwise direction.

In this embodiment, however, because the blades 9 of the impeller 7 are curved in a concave shape on the pressure side 9A, the blades 9 have a curved shape that is backward-swept near the leading edge 9C and is forward-swept near the trailing edge 9D with respect to the maximum-curvature position 9B, where the curvature is maximized, the blades 9 are shaped such that the maximum-curvature position 9B is located rearmost in the rotational direction, and the inner diameter of the cascade of blades increases gradually from the hub 8 toward the shroud 10, the intake flow taken in in the direction along the rotating shaft of the impeller 7 can be taken in at an angle closer to a right angle with respect to the leading edge line of the blades 9, thus reducing the inflow loss of the intake flow.

In addition, because the diameter of the maximum-curvature position 9B of the blades 9 becomes smaller toward the hub 8, the pressure rise starting position between the blades 9 is shifted upstream near the hub 8, and accordingly the interblade pressure rises earlier near the hub 8. This forms a pressure gradient extending from the hub 8 toward the shroud 10 between the blades 9 to tilt the flow between the blades 9 toward the shroud 10, thus making the entire flow uniform in the spanwise direction of the blades 9. Thus, the blades 9 can be shaped to better match the flow, which inhibits a flow disturbance through the impeller 7 to reduce fan input power and noise, thus increasing the performance and efficiency of the multi-blade centrifugal fan 1 and reducing the noise therefrom.

In particular, if the inner diameter of the cascade of blades 9 near the hub 8 of the impeller 7 is D1*h*, the outer diameter of the cascade of blades 9 near the hub 8 is D2*h*, the diameter of the maximum-curvature position 9B near the hub 8 is D3*h*, the inner diameter of the cascade of blades near the shroud 10 is D1*t*, the outer diameter of the cascade of blades near the shroud 10 is D2*t*, and the diameter of the maximum-curvature position near the shroud 10 is D3*t*, then the inner diameter D1*h* near the hub 8 is smaller than the inner diameter D1*t* near the shroud 10 (D1*h*<D1*t*), and (D3*t*−D1*t*)/(D2*t*−D1*t*) near the shroud 10 is larger than (D3*h*−D1*h*)/(D2*h*−D1*h*) near the hub 8; therefore, the diameter of the maximum-curvature position 9B of the cascade of blades can be varied with the variation in inner diameter so that the diameter of the maximum-curvature position 9B of the blades 9 becomes smaller toward the hub 8, and accordingly the pressure rise starting position between the blades 9 is shifted upstream near the hub 8

This allows the interblade pressure to rise earlier near the hub 8 and forms a pressure gradient extending from the hub 8 toward the shroud 10 between the blades 9 to tilt the flow between the blades 9 toward the shroud 10, thus making the entire flow uniform in the spanwise direction of the blades 9, which inhibits a flow disturbance through the impeller 7 to reduce the fan input power and noise, thus increasing the performance and efficiency of the multi-blade centrifugal fan 1 and reducing the noise therefrom.

In addition, because the diameter of the maximum-curvature position 9B of the blades 9 changes so as to increase substantially linearly from the hub 8 toward the shroud 10, the pressure rise starting position between the blades 9 is shifted upstream near the hub 8 and, at the same time, changes smoothly and substantially linearly from the hub 8 toward the shroud 10. Accordingly, a substantially linear pressure gradient can be formed between the blades 9 from the hub 8 toward the shroud 10 to make the flow more uniform in the spanwise direction of the blades 9, thus further increasing the performance and efficiency of the multi-blade centrifugal fan 1.

In addition, if the radius of curvature near the leading edge 9C, where the blades 9 of the impeller 7 are backward-swept, is r1, the radius of curvature near the trailing edge 9D, where the blades 9 are forward-swept, is r2, and the radius of curvature of the maximum-curvature position 9B is r3 in a cross-section perpendicular to the rotating shaft 6, then the radii of curvature r1, r2, and r3 satisfy r3<r1 and r3<r2; therefore, at the entrance and exit portions of the blades 9, where flow separation tends to occur, the radii of curvature r1 and r2 near the leading edge 9C, where the blades 9 are backward-swept, and the trailing edge 9D, where the blades 9 are forward-swept, each corresponding to either portion, are made larger to reduce the load on the entrance and exit portions of the blades 9, thereby stabilizing the flow.

Furthermore, the entrance angle βb1 at the leading edge 9C, where the blades 9 are backward-swept, can be adjusted to the flow direction without reducing the spacing between the blades 9 so that the intake flow can be smoothly taken in. This inhibits a flow disturbance at the entrance and exit portions of the blades 9 for increased efficiency and reduced noise. In this case, if the radii of curvature r1, r2, and r3 satisfy r3<r1<r2, that is, if the radius of curvature r2 near the trailing edges 9D of the blades 9, where the flow has a higher velocity, is the largest, the load on the blade exit portions, where separation tends to occur, can be further reduced to further stabilize the flow. This inhibits a flow disturbance at the exit portions of the blades 9 for further increased efficiency and reduced noise.

In addition, because the entrance angle βb1 of the blades 9 is 50° or less in a cross-section perpendicular to the rotating shaft 6 of the impeller 7, the entrance angle βb1 of the blades 9 matches a typical relative inflow angle, thereby reducing the inflow loss of the intake flow. This improves the blowing efficiency of the multi-blade centrifugal fan 1 for increased performance. In this embodiment, furthermore, because the entrance angle βb1 of the blades 9 increases gradually from the hub 8 toward the shroud 10, the difference (angle of deflection) between the entrance angle βb1 and the exit angle βb2 decreases gradually from the hub 8 toward the shroud 10, so that the flow can be stabilized without abrupt deflection near the shroud 10, where the difference between the inner and outer diameters decreases as the inner diameter increases. This allows for increased blowing efficiency and reduced noise.

In this embodiment, additionally, because the number of blades 9 on the impeller 7, N, is 15≤N ≤30, the friction loss in the interblade channels can be controlled within an appropriate range, that is, a range of friction loss that is neither insufficient nor excessive, which allows the flow between the blades 9 to be confined and blown out from the impeller 7 in the centrifugal direction. This inhibits a backflow in the flow through the impeller 7 for increased blowing efficiency and reduced noise.

Furthermore, if the outer diameter of the cascade of blades near the hub 8 of the impeller 7 is D2*h* and the outer diameter of the cascade of blades near the shroud 10 is D2*t*, then the outer diameter D2*h* and D2*t* satisfy D2*h*≤D2*t*; therefore, the exit peripheral velocity of the blades 9 is higher near the shroud 10 than near the hub 8, and accordingly the pressure rise is larger near the shroud 10. This increases the blowing efficiency near the shroud 10, thus further increasing the efficiency and performance of the multi-blade centrifugal fan 1.

In this embodiment, additionally, because the stagger angle γ of the blades 9 decreases gradually from the hub 8 toward the shroud 10 in a cross-section perpendicular to the rotating shaft 6 of the impeller 7, the radii of curvature r1, r2, and r3 of the blades 9 near the leading edge 9C, near the trailing edge 9D, and at the maximum-curvature position 9B in a cross-section perpendicular to the rotating shaft 6 of the impeller 7 each vary more smoothly from the hub 8 toward the shroud 10 if, as noted above, the entrance angle βb1 increases gradually from the hub 8 toward the shroud 10, or if the exit angle βb2 increases gradually from the hub 8 toward the shroud 10. This inhibits a flow disturbance to reduce the fan input power and noise, thus further increasing the performance and efficiency of the multi-blade centrifugal fan 1.

Furthermore, the multi-blade centrifugal fan 1, which has increased performance and reduced noise, as noted above, can be similarly installed as an air blower fan in an air conditioner for use in, for example, a building or automobile to increase the performance and efficiency of the air conditioner and to reduce noise therefrom, thus increasing its commercial value.

{Second Embodiment}

Next, a second embodiment of the present invention will be described using FIGS. 17 and 18.

This embodiment differs from the first embodiment described above in that the maximum-curvature position 9B of the blades 9 is more advanced in the rotational direction near the shroud 10 than near the hub 8. Other features are similar to those of the first embodiment, and a description thereof is therefore omitted.

Figure 17:
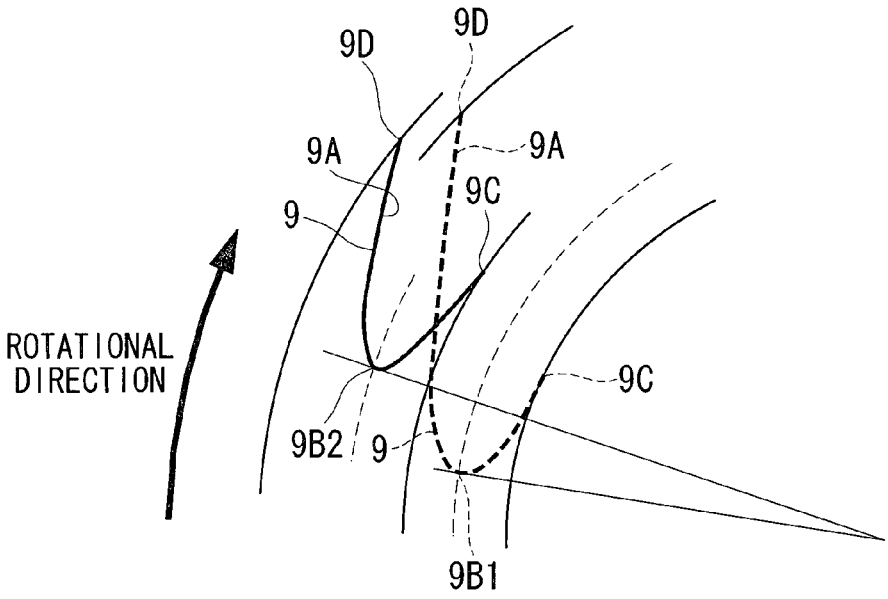
FIG. 17 is a schematic view showing the dimensions of various portions of blades according to a second embodiment of the present invention in a cross-section perpendicular to a rotating shaft.

Referring to FIG. 17, in this embodiment, the position of the maximum-curvature position 9B of the blades 9 is gradually advanced in the rotational direction from the hub 8 toward the shroud 10 in a cross-section perpendicular to the rotating shaft 6 of the impeller 7 such that a maximum-curvature position 9B2 near the shroud 10 is more advanced than a maximum-curvature position 9B1 near the hub 8.

Figure 18:
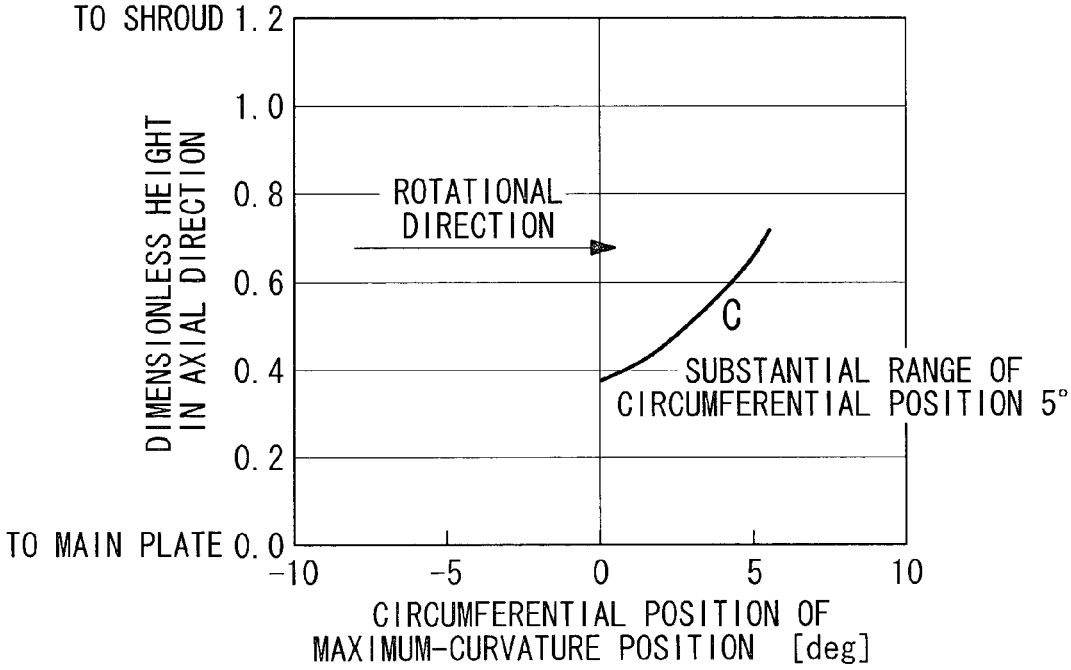
FIG. 18 is a graph showing the relationship between the circumferential position of the maximum-curvature position of the blades shown in FIG. 17 and the height in the axial direction as dimensionless height.

That is, in this embodiment, the circumferential position of the maximum-curvature position 9B, as indicated by the solid line C in FIG. 18, is advanced in a smooth curve in the rotational direction from the hub 8 toward the shroud 10. In this case, additionally, it is desirable to set the exit angle βb2 of the blades 9 such that it gradually increases from the hub 8 toward the shroud 10 in a cross-section perpendicular to the rotating shaft 6 of the impeller 7.

Because, as above, the position of the maximum-curvature position 9B of the blades 9 in the rotational direction is gradually advanced in a cross-section perpendicular to the rotating shaft 6 of the impeller 7 such that the maximum-curvature position 9B2 near the shroud 10 is more advanced than the maximum-curvature position 9B1 near the hub 8, the force of the blades 9 can be increased near the shroud 10, where a backflow tends to occurs, thus inhibiting a backflow in the flow near the shroud 10 for increased blowing efficiency and reduced noise. In this case, if the exit angle βb2 gradually increases from the hub 8 toward the shroud 10, the force of the blades 9 can be further increased near the shroud 10, where a backflow tends to occurs. This inhibits a backflow in the flow near the shroud 10 for further increased blowing efficiency and reduced noise.

{Third Embodiment }

Next, a third embodiment of the present invention will be described using FIGS. 19 to 21.

This embodiment differs from the first and second embodiments described above in that the trailing edge line of the blades 9 of the impeller 7 is tilted in a direction opposite to the rotational direction from the hub 8 toward the shroud 10. Other features are similar to those of the first and second embodiments, and a description thereof is therefore omitted.

Figure 19:
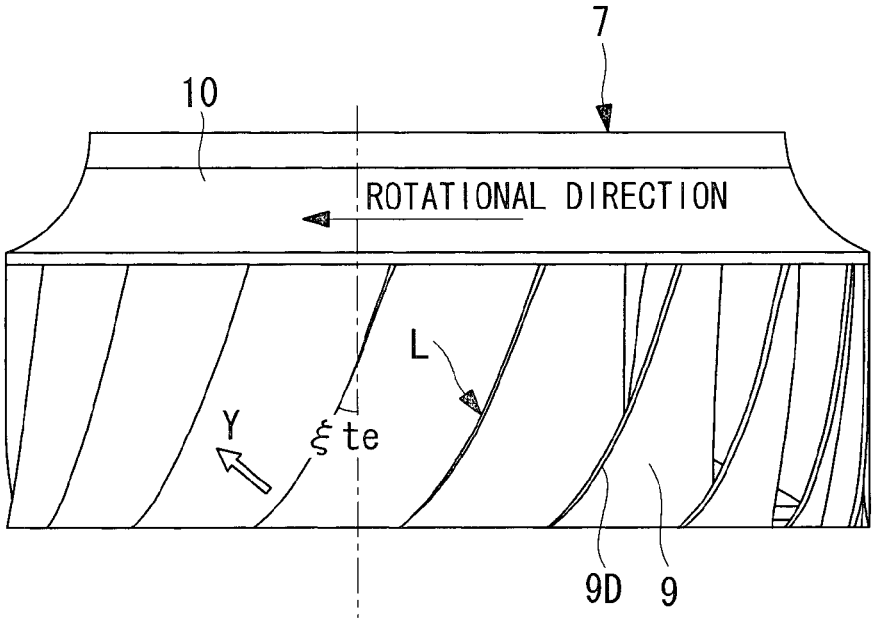
FIG. 19 is a side view showing the tilt angle of the trailing edges of blades of an impeller according to a third embodiment of the present invention.

Referring to FIG. 19, in this embodiment, the line L formed by the trailing edges 9D of the blades 9 is tilted in the direction opposite to the rotational direction from the hub 8 toward the shroud 10.

If the tilt angle between the trailing edge line L and the rotating shaft 6 of the impeller 7 is ate, the trailing edge line L is defined as follows:

(1) The tilt angle ξte is substantially constant from the shroud 10 toward the hub 8.

(2) The tilt angle ξte increases gradually from the shroud 10 toward the hub 8.

(3) The tilt angle ξte is substantially constant near the shroud 10, decreases gradually therefrom to a central region in the direction along the rotating shaft 6 of the impeller 7, and increases gradually therefrom toward the hub 8.

Figure 20:
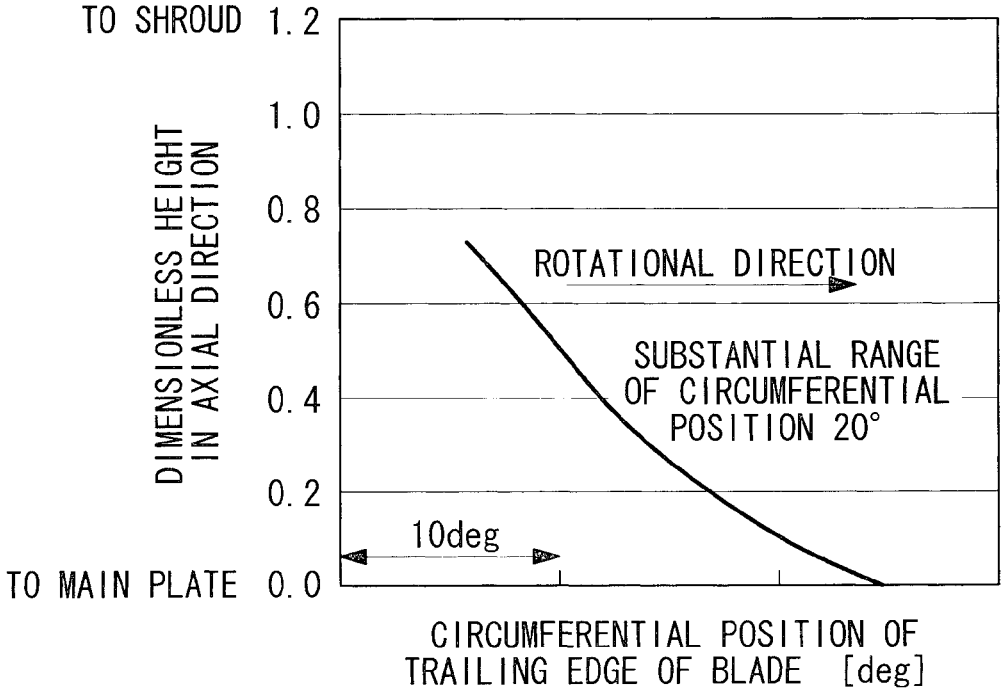
FIG. 20 is a graph showing the relationship between the circumferential position of the trailing edges of the blades shown in FIG. 19 and the height in the axial direction as dimensionless height.
Figure 21:
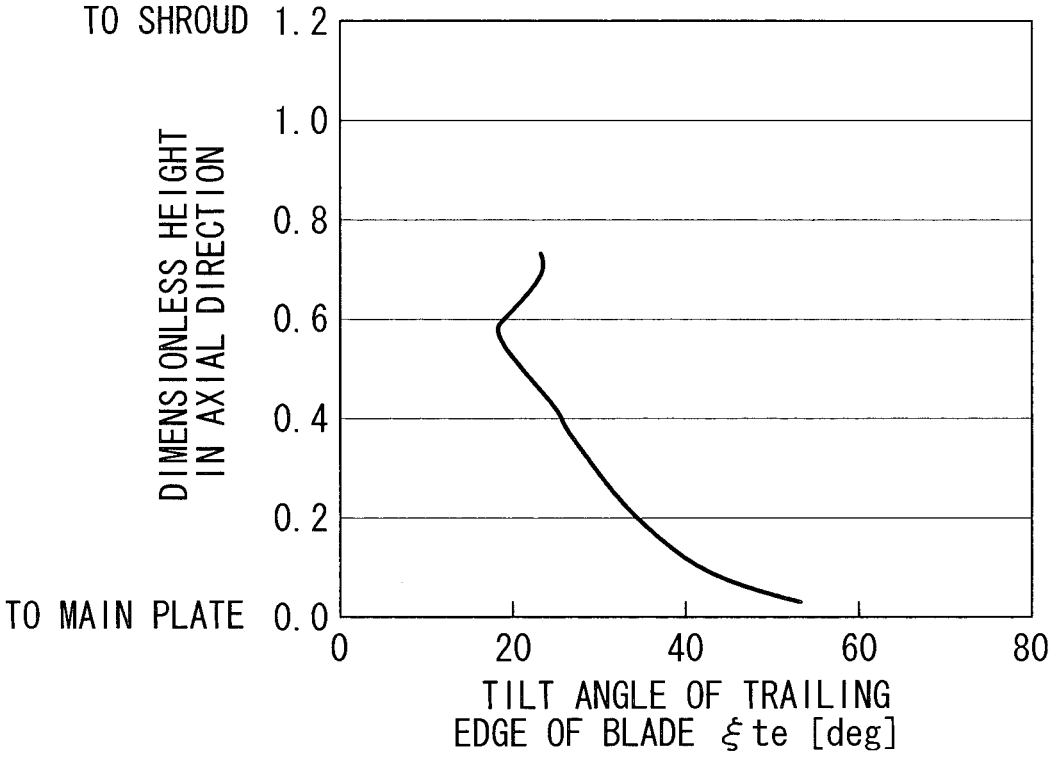
FIG. 21 is a graph showing the relationship between the tilt angle of the trailing edges of the blades shown in FIG. 19 and the height in the axial direction as dimensionless height.

FIGS. 20 and 21 illustrate the relationship between the circumferential position of the trailing edge line L and the height in the axial direction and the relationship between the tilt angle of the trailing edges of the blades and the height in the axial direction for case (3) above.

As above, if the trailing edge line L of the blades 9 is tilted in the direction opposite to the rotational direction from the hub 8 toward the shroud 10, the direction Y of the action of the blade force on the flow blown out from the trailing edges 9D of the blades 9 (see FIG. 19) is directed toward the shroud 10, which inhibits flow concentration near the hub 8 and allows the interblade flow to be directed toward the shroud 10, thus making the entire flow uniform in the spanwise direction of the blades 9.

If the tilt angle ξte is substantially constant from the shroud 10 toward the hub 8, as in case (1) above, the direction Y of the action of the blade force on the flow blown out from the trailing edges 9D of the blades is directed toward the shroud 10 substantially uniformly over the entire region in the direction along the rotating shaft, which corrects flow concentration near the hub 8 and allows the interblade flow to be directed toward the shroud 10, thus making the entire flow uniform in the spanwise direction of the blades 9.

In addition, if the tilt angle ξte increases gradually from the shroud 10 toward the hub 8, as in case (2) above, the direction Y of the action of the blade force on the flow blown out from the trailing edges 9D of the blades is directed more toward the shroud 10 near the hub 8, where the flow tends to concentrate, which corrects flow concentration near the hub 8 and allows the interblade flow to be directed toward the shroud 10, thus making the entire flow uniform in the spanwise direction of the blades 9.

Furthermore, if the tilt angle ξte is substantially constant near the shroud 10, decreases gradually therefrom to the central region in the direction along the rotating shaft 6 of the impeller 7, and increases gradually therefrom toward the hub 8, as in case (3) above, the direction Y of the action of the blade force on the flow blown out from the trailing edges 9D of the blades is directed in the direction along the shroud 10 near the shroud 10, remains in that state therefrom to the central region, and is directed more toward the shroud 10 near the hub 8, where the flow tends to concentrate, which corrects flow concentration near the hub 8 and allows the interblade flow to be directed toward the shroud 10, thus making the entire flow uniform in the spanwise direction of the blades 9. In particular, the variation in the tilt angle ξte of the trailing edge line L as in case (3) above allows the direction Y of the action of the blade force to be adjusted to a preferred direction without substantially increasing the blade length.

Thus, this embodiment corrects flow concentration near the hub 8 to make the entire flow uniform in the spanwise direction of the blades 9 by tilting the trailing edge line of the blades 9 in the direction opposite to the rotational direction from the hub 8 toward the shroud 10 and setting the tilt angle ξte thereof as in cases (1) to (3) above, which, in particular, increases the blowing efficiency near the shroud 10, thus further increasing the efficiency and performance of the multi-blade centrifugal fan 1 and reducing the noise therefrom.

{Fourth Embodiment}

Next, a fourth embodiment of the present invention will be described using FIG. 22.

This embodiment differs from the first to third embodiments described above in that the outer diameter of the shroud 10 is smaller than the outer diameter of the trailing edges 9D of the blades 9. Other features are similar to those of the first to third embodiments, and a description thereof is therefore omitted.

Figure 22:
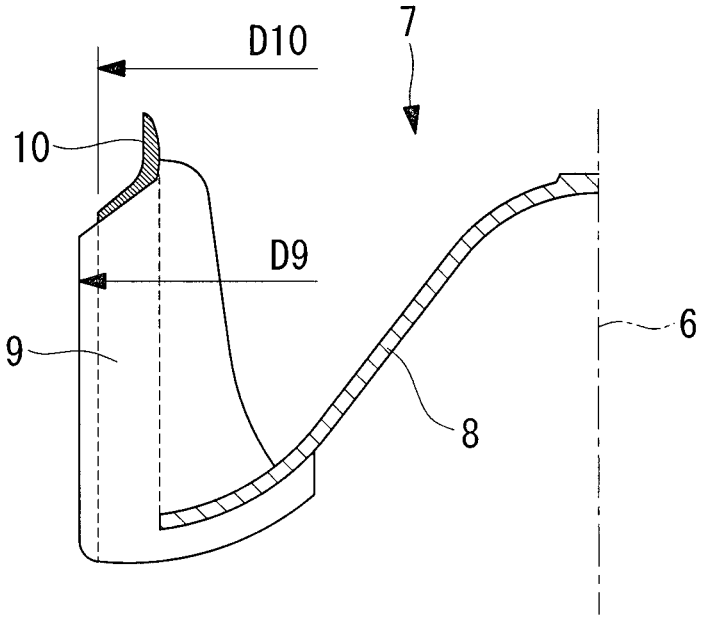
FIG. 22 is a schematic view illustrating a blade of an impeller according to a fourth embodiment of the present invention in a cross-section taken along a meridian.

Referring to FIG. 22, in this embodiment, the outer diameter D10 of the shroud 10 of the impeller 7 is smaller than the outer diameter D9 of the trailing edges 9D of the blades 9, and the portions near the trailing edges 9D of the blades 9 do not overlap the shroud 10 in the direction along the rotating shaft 6 of the impeller 7.

Because, as above, the outer diameter D10 of the shroud 10 of the impeller 7 is smaller than the outer diameter D9 of the trailing edges 9D of the blades 9, and the portions near the trailing edges 9D of the blades 9 do not overlap the shroud 10 in the direction along the rotating shaft 6 of the impeller 7, an impeller 7 including blades 9 whose trailing edge line L is tilted in the direction opposite to the rotational direction from the hub 8 toward the shroud 10 can be relatively easily formed as one piece by injection molding of a plastic material using different mold halves for the portions near the trailing edges of the blades 9 and the portions of the blades overlapping the shroud 10 in the direction along the rotating shaft 6, with the split line between the mold halves set at the broken line shown in FIG. 22. Thus, a one-piece plastic impeller 7 can be formed at low cost by injection molding using a pair of mold halves that are separable in the direction along the rotating shaft.

{Fifth Embodiment }

Next, a fifth embodiment of the present invention will be described using FIG. 23.

This embodiment differs from the first to third embodiments described above in that the outer diameter of the hub 8 is larger than or equal to the outer diameter of the trailing edges 9D of the blades 9. Other features are similar to those of the first to third embodiments, and a description thereof is therefore omitted.

Figure 23:
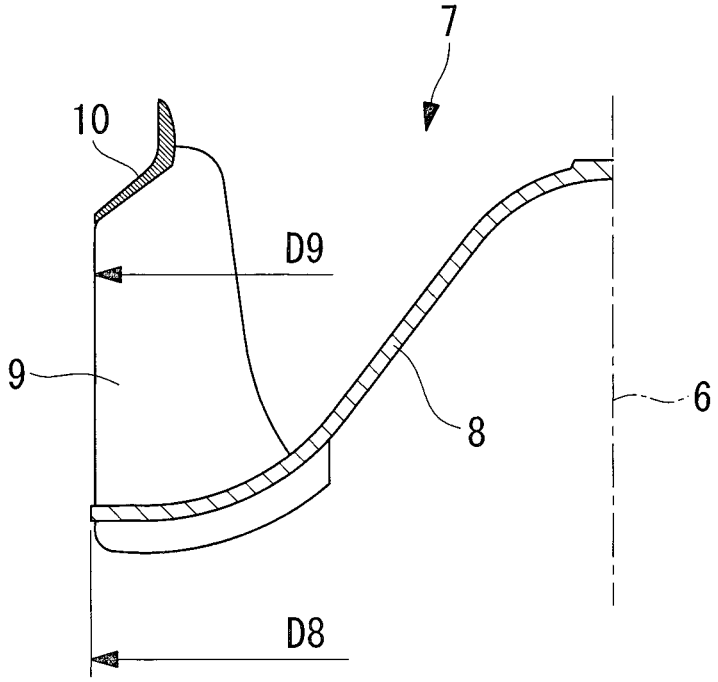
FIG. 23 is a schematic view illustrating a blade of an impeller according to a fifth embodiment of the present invention in a cross-section taken along a meridian.

Referring to FIG. 23, in this embodiment, the outer diameter D8 of the hub 8 of the impeller 7 is larger than or equal to the outer diameter D9 of the trailing edges 9D of the blades 9, and the ends of the blades 9 on the hub side are fixed to the hub 8 from the leading edge 9C to the trailing edge 9D by joining or fitting.

Because, as above, the outer diameter D8 of the hub 8 of the impeller 7 is larger than or equal to the outer diameter D9 of the trailing edges 9D of the blades 9, and the ends of the blades 9 on the hub side are fixed to the hub 8 from the leading edge 9C to the trailing edge 9D by joining or fitting, an impeller 7 including blades 9 having a large exit angle βb2 can be prevented from being deformed in the blades 9 thereof due to centrifugal force or fluid force by fixing the ends of the blades 9 on the hub side to a hub having an outer diameter D8 larger than or equal to the outer diameter D9 of the blades 9 by joining or fitting. This allows the exit angle βb2 of the blades 9 to be increased and, particularly, inhibits a backflow in the flow near the shroud 10 for further increased efficiency and reduced noise.

The present invention is not limited to the invention according to the above embodiments; various modifications are permitted without departing from the spirit thereof. For example, while the one-sided intake multi-blade centrifugal fans 1, which take in air from one side of the scroll-shaped casing 2, have been illustrated in the above embodiments, it is to be understood that the present invention is also applicable to double-sided intake multi-blade centrifugal fans.

In addition, the scroll-shaped casing 2 and the impeller 7 are not limited to those made of plastic; it is to be understood that they may instead be made of metal.

Furthermore, the multi-blade centrifugal fan 1 according to the present invention is not limited to air conditioners, as noted above; it is to be understood that it is widely applicable to air blowers for other equipment.

REFERENCE SIGNS LIST

1 multi-blade centrifugal fan
2 casing
6 rotating shaft
7 impeller
8 hub (main plate)
9 blade
9A pressure side
9B, 9B1, 9B2 maximum-curvature position
9C leading edge
9D trailing edge
10 shroud
L trailing edge line
D8 outer diameter of hub
D9 outer diameter of trailing edge of blade
D10 outer diameter of shroud

The invention claimed is:

1. A multi-blade centrifugal fan comprising an impeller rotatably disposed in a scroll-shaped casing, the impeller comprising a disc-shaped hub, a plurality of blades arranged on a periphery of the hub, and an annular shroud disposed at opposite ends of the blades from the hub, wherein the blades are curved in a concave shape on a pressure side in a cross-section perpendicular to a rotating shaft of the impeller and have a curved shape that is backward-swept at a leading edge thereof and that is forward-swept at a trailing edge thereof;

the inner diameter of the cascade of blades increases gradually from the hub toward the shroud, and the diameter of a maximum-curvature position where the curvature of the curved shape is maximized increases gradually from the hub toward the shroud, and wherein if the radius of curvature at the leading edge, where the blades are backward-swept, is r1, the radius of curvature at the trailing edge, where the blades are forward-swept, is r2, and the radius of curvature of the maximum-curvature position is r3 in a cross-section perpendicular to the rotating shaft of the impeller, then the radii of curvature r1, r2, and r3 satisfy r3<r1 and r3<r2.

2. The multi-blade centrifugal fan according to claim 1, wherein if the inner diameter of the cascade of blades at the hub of the impeller is D1*h*, the outer diameter of the cascade of blades at the hub is D2*h*, the diameter of the maximum-curvature position at the hub is D3*h*, the inner diameter of the cascade of blades at the shroud is D1*t*, the outer diameter of the cascade of blades at the shroud is D2*t*, and the diameter of the maximum-curvature position at the shroud is D3*t*, then the inner diameter D1*h*at the hub is smaller than the inner diameter D1*t* at the shroud, and (D3*t*−D1*t*)/(D2*t*−D1*t*) at the shroud is larger than (D3*h*−D1*h*)/(D2*h*−D1*h*) at the hub.

3. The multi-blade centrifugal fan according to claim 1, wherein the diameter of the maximum-curvature position changes substantially linearly from the hub toward the shroud.

4. The multi-blade centrifugal fan according to claim 1, wherein the radii of curvature r1, r2, and r3 satisfy r3<r1<r2.

5. The multi-blade centrifugal fan according to claim 1, wherein the entrance angle βb1 of the blades is 50° or less in a cross-section perpendicular to the rotating shaft of the impeller.

6. The multi-blade centrifugal fan according to claim 5, wherein the entrance angle βb1 of the blades increases gradually from the hub toward the shroud.

7. The multi-blade centrifugal fan according to claim 1, wherein the number of blades on the impeller, N, is 15≤N≤30.

8. The multi-blade centrifugal fan according to claim 1, wherein the maximum-curvature position of the blades is more advanced in a rotational direction at the shroud than at the hub in a cross-section perpendicular to the rotating shaft of the impeller.

9. The multi-blade centrifugal fan according to claim 8, wherein the exit angle βb2 of the blades increases gradually from the hub toward the shroud in a cross-section perpendicular to the rotating shaft of the impeller.

10. The multi-blade centrifugal fan according to claim 1, wherein if the outer diameter of the cascade of blades at the hub of the impeller is D2*h* and the outer diameter of the cascade of blades at the shroud is D2*t*, then the outer diameters D2*h* and D2*t* satisfy D2*h*≤D2*t*.

11. The multi-blade centrifugal fan according to claim 1, wherein a stagger angle γ of the blades decreases gradually from the hub toward the shroud in a cross-section perpendicular to the rotating shaft of the impeller.

12. The multi-blade centrifugal fan according to claim 1, wherein a trailing edge line of the blades is tilted in a direction opposite to a rotational direction from the hub toward the shroud.

13. The multi-blade centrifugal fan according to claim 12, wherein if a tilt angle between the trailing edge line of the blades and the rotating shaft of the impeller is ξte, the tilt angle ξte is substantially constant from the shroud toward the hub.

14. The multi-blade centrifugal fan according to claim 12, wherein if a tilt angle between the trailing edge line of the blades and the rotating shaft of the impeller is ξte, the tilt angle ξte increases gradually from the shroud toward the hub.

15. The multi-blade centrifugal fan according to claim 12, wherein if a tilt angle between the trailing edge line of the blades and the rotating shaft of the impeller is ξte, the tilt angle ξte is substantially constant at the shroud, decreases gradually therefrom to a central region in a direction along the rotating shaft of the impeller, and increases gradually therefrom toward the hub.

16. The multi-blade centrifugal fan according to claim 1, wherein the outer diameter of the shroud of the impeller is smaller than the outer diameter of the trailing edges of the blades, and portions at the trailing edges of the blades do not overlap the shroud in a direction along the rotating shaft of the impeller.

17. The multi-blade centrifugal fan according to claim 1, wherein the outer diameter of the hub of the impeller is larger than or equal to the outer diameter of the trailing edges of the blades, and ends of the blades at the hub are fixed to the hub from the leading edge to the trailing edge by joining or fitting.

18. An air conditioner in which the multi-blade centrifugal fan according to claim 1 is installed as an air blower fan.

* * * * *